US005624780A

United States Patent [19]

Nishimori et al.

[11] Patent Number: 5,624,780

[45] Date of Patent: Apr. 29, 1997

[54] TONER IMAGE FIXING METHOD USING FLUORINE CONTAINING SILICONE OIL

[75] Inventors: Yoshiki Nishimori; Tatsuya Nagase; Hiroshi Yamazaki; Meizo Shirose; Kazuhiko Uneme; Masashi Saito; Kazuo Yasuda, all of Hachioji, Japan

[73] Assignee: Konica Corporation, Japan

[21] Appl. No.: 620,794

[22] Filed: Mar. 28, 1996

[30] Foreign Application Priority Data

Apr. 3, 1995 [JP] Japan ..... 7-077654
Jun. 2, 1995 [JP] Japan ..... 7-159883

[51] Int. Cl.[6] ..... G03G 13/20

[52] U.S. Cl. ..... 430/124; 430/99

[58] Field of Search ..... 430/99, 124

[56] References Cited

U.S. PATENT DOCUMENTS 5,270,770 12/1993 Kukimoto et al. ..... 430/106.6
5,307,122 4/1994 Ohno et al ..... 430/111
5,395,725 3/1995 Bluett et al. ..... 430/124

*Primary Examiner*—Roland Martin
*Attorney, Agent, or Firm*—Bierman and Muserlian

[57] ABSTRACT

Disclosed is a toner image forming method, comprising steps of:

(1) forming a latent image on an image carrying member, (2) developing said latent image with toner particles including a resin and a colorant so as to form a toner image, said toner particles having a volume average particle size of 5 to 10 μm, and containing toner particles having particle sizes of not more than 5.04 μm in 5 number·% to 60 number·%, (3) transferring said toner image onto an image receiving material, and (4) fixing said transferred toner image on said image receiving material, said fixing steps comprising (a) passing said image receiving material between a movable fixing member and a rotatable pressure applying member each having a surface facing each other, (b) heating said toner image by a heater incorporated in said fixing member, and (c) coating the surface of said fixing member facing said pressure applying member with a fluorine-containing silicone oil by a coating roller, said fluorine-containing silicone oil having a structure unit represented by Formula I: Formula I wherein X represents an alkyl group having 1 to 4 carbon atoms or an aryl group, Rf represents a fluoroalkyl group having 2 to 10 carbon atoms and n represents an integer of 1 to 4.

9 Claims, 12 Drawing Sheets

TRANS MISSION RATE OF TONER IMAGE AREA

LINE SPEED : 16 mm / sec
LOWER ROLLER EXTERNAL
DIAMETER : $\phi$ 30 mm
HARDNESS OF LOWER
ROLLER : ASUKA C HARDNESS 40°

LINE SPEED : 16 mm / sec
LOWER ROLLER EXTERNAL DIAMETER : $\phi$ 30 mm
HARDNESS OF LOWER ROLLER : ASUKA C HARDNESS 40°

LINE SPEED-TRANS MISSION RATE ( 190℃ )

HARDNESS OF UPPER ROLLER :
ASUKA C HARDNESS 91°
HARDNESS OF LOWER ROLLER :
ASUKA C HARDNESS 86°

TONER IMAGE FIXING METHOD USING FLUORINE CONTAINING SILICONE OIL

The present invention relates to an image forming method, and more particularly, to an image forming method wherein toner images are fixed by means of heat fixing.

Conventionally, as a method for fixing an image formed by toner for a dry type electrophotography on a recording material, there is generally used a heat fixing method wherein, by the use of a constitution such as heat roller fixing, a toner image is heated and pressed by means of a fixing roller kept at temperature higher than toner's softening temperature so that toner particles are fused and deformed, and then, fixed on a recording material. However, in the above-mentioned heat fixing method, a so-called offset phenomenon often occurs wherein fused toner adheres on a fixing roller to easily stain the image.

As a countermeasure for preventing the above-mentioned offset phenomenon, to add a releasing agent to the toner particles has been tried. Japanese Patent Publication Open to Public Inspection (hereinafter referred to as Japanese Patent O.P.I. Publication) No. 65231/1974 discloses a technology to add a releasing agent such as a low molecular weight polypropylene to the toner. Namely, in this technology, when fixing, the releasing agent contained in toner particles is fused so that a layer containing a separating agent at an interface of the fixing roller and toner particles is formed so that adherence of fused toner on the fixing roller can be prevented. This is useful technology.

On the other hand, recently, as disclosed in Japanese Patent O.P.I. Publication No. 130783/1991, small particle size toner has been demanded for the purpose of enhancing image quality. In an image before fixing formed with toner of a small particles, compared to an image composed of conventional toner of larger particles, individual toner particles are filled more closely against each other so that spaces among toner particles are small. When fixing the former toner layer, the releasing agent, contained in the toner particles and positioned at the lower portion of the toner layer, is difficult to bleed out to the surface of the toner layer, i.e., interface with the fixing roller. Namely, in the case of small-particle size toner, even when the releasing agent is added in the toner as described above, the desired effects are not obtained sufficiently during fixing. Therefore, it is insufficient to prevent the occurrence of offset.

As another means for preventing offset, it is effective to provide a means wherein a silicone oil is coated on the surface of the fixing roller, which contacts the toner, so that the toner is difficult to adhere onto the fixing roller. Improving the durability of the fixing roller and the toner releasing property by providing a laminated layer, with low surface energy, composed of a fluorine-containing resin such as PFA on the surface of the fixing roller is generally conducted. However, when employing the above-mentioned laminated roller, since it is difficult to maintain the silicone oil onto the surface of a layer laminated with a fluorine-containing resin, sufficient offset prevention effect still cannot be obtained. Specifically, Japanese Patent O.P.I. Publication No. 124338/1977 discloses a fixing device which uses a fluoropropylmethyl silicone oil having a trifluoromethyl group at the end for the purpose of improving oil retention on the surface of the fixing roller. However, oil retention of the silicone oil described in aforesaid specification on the fixing member is low since the fluorine content is also low. Therefore, sufficient offset prevention effects cannot be obtained.

Recently, as a fixing apparatus in place of the fixing roller, a technology, wherein a fixing roller is pressed onto a heating member through a band-shaped film member moving on the fixed heating member and a recording paper carrying toner image is passed through them for fixing, is disclosed in Japanese Patent O.P.I. Publication No. 119530/1993. Though this fixing method is a superior fixing method in terms of heat effectiveness, it has problems similar to those described in the above-mentioned heat roller fixing method.

SUMMARY OF THE INVENTION

A first object of the present invention is to provide an image forming method wherein enhancement of image quality is achieved by employing toner particles of a specific average particle size and grading distribution (reducing particle size) so that durability of the fixing apparatus is improved and the occurrence of fixing offset on the fixing means is prevented.

Next, conventional examples of the fixing apparatuses will be explained.

As the fixing apparatus used in an image forming apparatus, the fixing rollers which allow fixing the toner image onto a recording medium such as a copying paper or an OHP and fixing rollers having a providing roller providing oil on the above-mentioned fixing roller are generally used.

An oil coating method wherein rolling of the recording medium is prevented by coating an oil on the fixing roller is generally of two types. One type is that a roller or a pad is immersed in the oil, the oil oozes out over time and the oil is thus coated onto the surface of the fixing roller. The other type has an oil supplying mechanism which is started to be used again in image forming apparatus such as a full color PPC. The latter type tends to coat a large amount of oil.

In view of demands of high durability and toner releasing property the roller used for the fixing roller is frequently a hollow aluminum pipe wherein a fluorine resin, whose surface tension is low, is coated thereon. In addition, heat is transferred by inserting a halogen lamp into the pipe. Since the fixing roller to which heat is transferred is a rigid body, heat transfer to the fixing roller having fine unevenness is not uniform. Accordingly, the surface of the roller after heat transfer becomes uneven, and in some occasion, it has minute offset. Therefore, a problem that its quality is not high has been pointed out. As a countermeasure, for a material of the fixing roller, a rubber roller having an elastic layer has frequently been adopted. In this occasion too, oil coating is employed.

There are some cases when we want to process a thicker recording medium such as an envelope, not only a plain paper as the recording medium. However, in such occasions, in the case of the above-mentioned conventional apparatuses, the fixing property on a thick paper is poor. In addition, in the case of the OHP sheet, improvement of light transmission rate has been demanded so that the coating amount of oil is increased. However, a problem of reduced durability of the fixing roller and the coating roller has occurred.

A second object of the present invention is to overcome the problems of the above-mentioned conventional apparatuses. Practically, to provide the fixing apparatus wherein fixing of a thick recording medium such as an envelope is capable, improvement of the light transmission rate of the OHP sheet is capable and improvement of durability of the fixing roller and the coating roller is also capable.

SUMMARY OF THE INVENTION

The first object of the present invention is attained by the following items.

Item 1. An image forming method in which by the use of toner image using toner comprised of a resin and a colorant, a recording material carrying the above-mentioned toner image is passed between a moving fixing member and a pressure member which is brought into pressure contact with the abovementioned fixing member and rotates, and then, the abovementioned toner image is subjected to heat fixing through the above-mentioned fixing member by means of a heating member, wherein the above-mentioned toner contains a component whose particle size is 5.04 μm or less by 5 through 60 number % and the volume average particle size is 5 through 10 μm and a fluorine-containing silicone oil having a structure unit represented by the following Formula [I] is coated on the surface of the pressure member side of aforesaid fixing member. Formula [I]

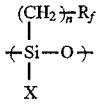

wherein X represents an alkyl group having 1 through 4 carbon atoms or an aryl group; Rf represents a fluoroalkyl group having 2 through 10 carbon atoms; and n represents an integer of 1 through 4.

Item 2. The image forming method described in item 1, wherein the fixing member is a fixing roller housing the heating member and having a fluorine-containing resin-coated layer on its surface.

Item 3. The image forming method described in item 1, wherein the fixing member is a band-type member having the fluorine-containing resin-coated layer on its surface.

In the present invention, by setting the constitution of toner grading so that the volume average particle size is 5 through 10 μm and specifically the proportion of toner particles whose particle size of not more than 5.04 μm is 5 through 60% by number, high image quality can be attained. This is due to the fact that toner particles whose particle size of not more than 5.04 μm, contribute to development with high fidelity to the edge portion of latent images.

Toner, whose particle size is reduced compared to conventional ones, is insufficient in terms of effects of a releasing agent during fixing so that offset easily occurs. To the contrary, the present invention can prevent the occurrence of offset by coating the fluorine-containing silicone oil on the surface of a fixing member. The fluorine-containing silicone oil of the present invention is extremely excellent compared to conventional fluorine-containing silicone oils in terms of wetability onto the surface of the fixing member. Particularly on materials, whose surface energy is low, composed of a fluorine-containing resin such as PFA wherein wetability is so poor that it is difficult to be uniformly coated, uniform coating can be conducted so that it is extremely effective in preventing offset. In the present invention, a term "wetability" means a uniform layer forming ability on the surface of the fixing member.

The fluorine-containing silicone oil of the present invention is a silicone oil having a structural unit represented by the Formula [I].

In Formula [I], X represents an alkyl group having 1 through 4 carbon atoms such as a methyl group or an aryl group such as a phenyl group. Rf represents a fluoroalkyl group having 2 through 10 and preferably, a fluoroalkyl group 2 through 8 carbon atoms.

A preferable embodiment of Rf represents a group represented by $Z\text{-}(CF_2)_m\text{-}$ (z represents a hydrogen atom or a fluorine atom). m represents an integer of 2 through 10 and preferably 2 through 8, as in the above-mentioned fluoroalkyl group.

It is essential that the fluorine-containing silicone oil of the present invention has the structural unit represented by Formula [I]. In addition to the structural unit, for example, a copolymer with a structural unit such as dimethyl silicone, phenylmethyl silicone or diphenyl silicone may be employed as the fluorine-containing silicone oil of the present invention.

It is necessary that the fluorine-containing silicone oil of the present invention is present as liquid state with suitable viscosity when using and has a certain degree of molecular weight. Considering achievement ratio of the present invention and formation property of an oil layer on the fixing roller, when the molecular weight is represented by converting to viscosity, the viscosity of 20 through 1000 centi-poise (CS) at 25° C. is preferably employed, and 100 through 500 CS is particularly preferably employed. This viscosity is dynamic viscosity, measured by Ubbelohde viscometer based on ASTM D445-46T or JIS Z8803.

In addition, the viscosity can be controlled while adjusting with the degree of polymerization when the fluorine-containing silicone oil of the present invention is manufactured.

When the fluorine-containing silicone oil of the present invention is a copolymer, it is preferable that a structural unit represented by Formula [I] is contained in an amount of not less than 20 mol% of the fluorine-containing silicone oil. When it is contained in an amount of less than 20 mol%, contributions based on other structural units is easily displayed prominently and it is difficult to attain the objects of the present invention.

The second object of the present invention is attained by a fixing apparatus having a fixing roller for fixing a toner image on the recording medium and a coating roller which provides oil on the above-mentioned fixing roller, the fixing apparatus is composed of the fixing roller with an upper roller and a lower roller and providing the oil on the upper roller, wherein a silicone rubber layer and a resin layer are laminated on the upper roller base tube in this order or a resin layer is laminated on the base tube, the heat resistance of the upper roller is in the range of 2.5 through 7.9 cm·s·deg/cal, on the other hand, the silicone rubber layer can be laminated on the base tube of the above-mentioned lower roller and the difference of the roller hardness of the lower roller to the upper roller hardness is ±5°.

It is preferable that the thickness of the silicone rubber layer on the upper roller is in a range of 0.2 through 1 mm and that the thickness of the silicone rubber layer on the lower roller is in a range of 0.5 through 2 mm.

It is also preferable that the above-mentioned coating roller seals inorganic or organic fine particles in its hollow pipe for maintaining the oil, that the oil is caused to be oozed out from the oil emitting hole and that the heat durability temperature of above-mentioned fine particles is not less than 1100° C.

It is preferable that a fluoro-silicone oil is used for the above-mentioned oil and that the coating amount of oil is controlled to $1.4\times10^{-6}$ g/cm$^2$.

It is preferable that the viscosity of the abovementioned oil is 500 cs or less and that the surface tension thereof is not more than 20 dyne/cm.

It is also preferable that the coating amount of the oil is varied between a mono-color mode and a multi-color mode and that the coating amount of oil in the mono-color mode is not more than ¾ against the multi-color mode.

In an OHP mode, the line speed of the fixing roller is characterized to be not more than ½ against a normal mode.

It is preferable, in the OHP mode, that the amount of stuck toner fixed for developing is lower compared to the normal mode.

It is also preferable, in the case of the OHP mode, to coat a transparent resin, having visco-elasticity close to that of toner onto the outermost layer of the OHP sheet used.

In the present invention, with regard to the upper roller of the fixing rollers, the silicone rubber layer and the resin layer are laminated in this order on the base tube or the resin layer is laminated on the base tube and the heat resistance is in the range of 2.5 through 7.9 cm·s·deg/cal. On the other hand, with regard to the lower roller, the silicone rubber is laminated on the base tube and the difference of the roller hardness with the upper roller hardness is within ±5°. Accordingly, not only a plain paper as the recording medium but also thick recording mediums such as an envelope can be conveyed without wrinkling so that efficient fixing processing can be conducted.

Sine the thickness of the silicone rubber layer on the upper roller ranges between 0.2 through 1 mm and that on the lower roller ranges between 0.5 through 2 mm, even thick recording medium such as the envelope can be conveyed without wrinkling so that the toner can be molded smoothly and, also, due to the above-mentioned silicone layers, durability of the fixing roller is improved.

Since the coating roller seals inorganic or organic fine particles in its hollow pipe for retaining the oil and that the oil is caused to ooze out from tire oil emitting holes, it is possible to coat the oil uniformly by means of the coating roller and the coating amount may be small and uniform coating, wherein rolling of the recording medium due to a fully black image does not occur, is possible. Accordingly, noticeable up of reliability is achieved.

In the present invention, since the fluoro-silicone oil is used for the above-mentioned oil and that the coating amount of oil is controlled to $1.4\times10^{-6}$ g/cm$^2$, any amount of oil as necessary may be coated.

Since the viscosity of the above-mentioned oil is 500 cs or less and that the surface tension thereof is 20 dyne/cm or less, it is possible to coat the oil uniformly, and the coating amount may be small and uniform coating and rolling of the recording medium due to a fully black image does not occur is achieved. Accordingly, noticeable increase of reliability is achieved.

The coating amount of the oil is different between the mono-color mode and the multi-color mode and the coating amount of oil in the mono-color mode is ¾ or less compared to the multi-color mode, so that oil amount suitable for the mono-color mode and the multi-color mode is respectively provided.

Since in an OHP mode, the line speed of the fixing roller is ½ or less compared to the normal mode, oil amount suitable for the OHP mode and the normal mode is respectively provided.

In the OHP mode, the amount of stuck toner fixed for developing is lower compared to the normal mode and the transmission rate of OHP sheets is enhanced.

In the case of the OHP mode, a transparent resin having visco-elasticity close to that of toner on the outermost layer of the OHP sheet used is coated, and the transmission rate of the OHP sheet is enhanced.

DETAILED DESCRIPTION OF THE PREFERRED EMBODIMENT

Figure 1:
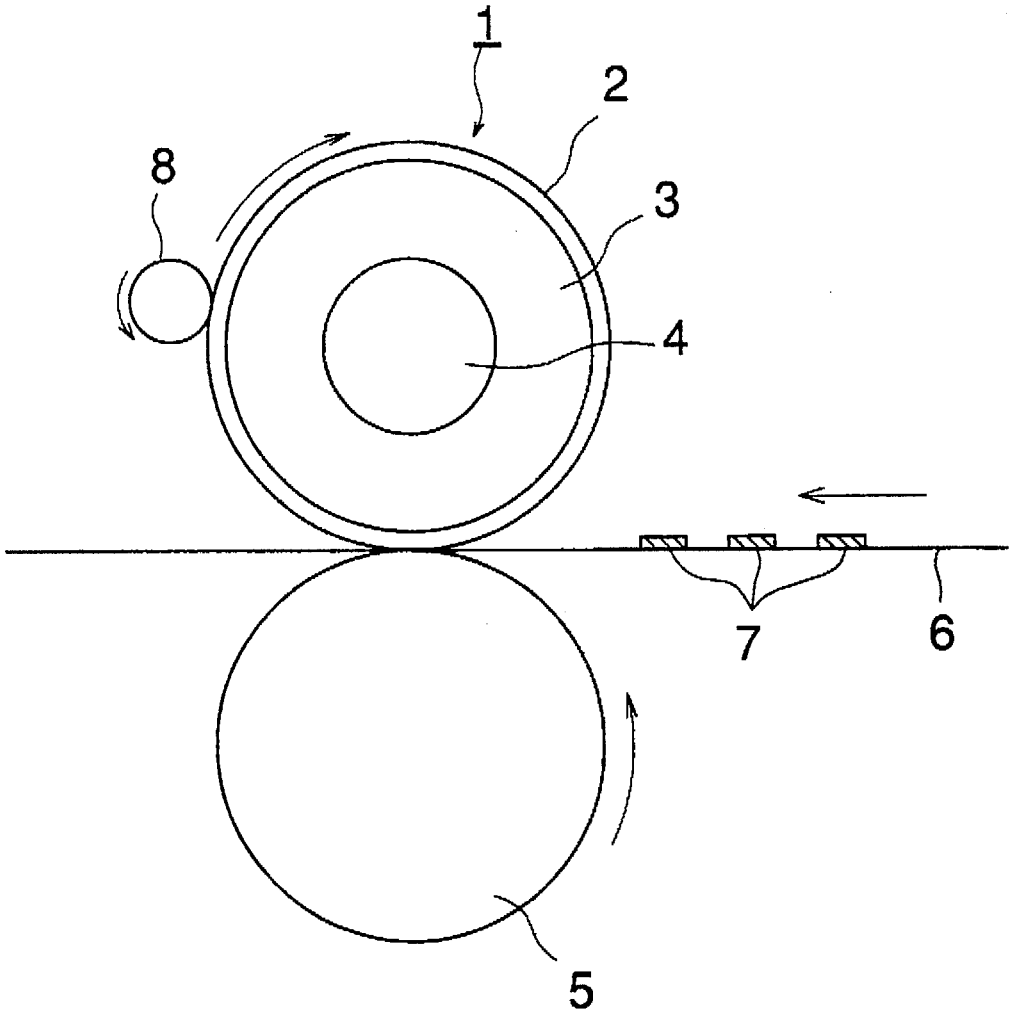
FIG. 1 is a drawing showing an example of a schematic structure of a heat roller fixing method showing an example of the present invention.

The manufacturing method of the fluorine-containing silicone oil of the present invention will be explained. As is in the same manner as the manufacturing method of ordinary silicone oil, a dialkyl-substituted dichlorosilane is regulated through reaction of silicon with alkyl chloride. The resulting compound is subjected to hydrolysis to make siloxane. Next, a cyclic olygomer or a linear oligomer is formed. Following this, these are polymerized. Thus, the fluorine-containing silicone oil is prepared. The fluorine-containing silicone oil of the present invention may ordinarily have a fluorinated alkyl group at a side chain. In such cases, the fluorine-containing silicone oil can easily be manufactured by using fluorine-containing compounds having a chloro group at the end in place of alkyl chloride, for example such as a compound having a structure represented by the following Formula [II], Formula [II]

$Z(CF_2)_m(CH_2)_nCl$ wherein Z, m and n are the same as those of Formula [I].

Hereunder, typical practical examples of compounds represented by Formula [II] will be cited as follows.

(A) $CF_3CF_2CH_2Cl$
(B) $CF_3CF_2CF_2CH_2Cl$
(C) $CF_3CF_2CF_2\ (CH_2)_2Cl$
(D) $CF_3CF_2CF_2CF_2(CH_2)_2Cl$
(E) $CF_3CF_2CF_2CF_2CF_2CH_2Cl$
(F) $CF_3CF_2CF_2CF_2CF_2(CH_2)_3Cl$
(G) $CF_3CF_2CF_2CF_2CF_2CF_2CH_2Cl$
(H) $CF_3CF_2CF_2CF_2CF_2CF_2CF_2CH_2Cl$
(I) $HCF_2CF_2CH_2Cl$
(J) $HCF_2CF_2CF_2CH_2Cl$
(K) $HCF_2CF_2CF_2(CH_2)_2Cl$ (L) $HCF_2CF_2CF_2CF_2CH_2Cl$ (M) $HCF_2CF_2CF_2CF_2\ (CH_2)_2Cl$ (N) $HCF_2CF_2CF_2CF_2(CH_2)_4Cl$ (O) $HCF_2CF_2CF_2CF_2CF_2(CH_2)_3Cl$ (P) $HCF_2CF_2CF_2CF_2CF_2CF_2CH_2Cl$

In the present invention, as alkyl chloride which introduces alkyl groups other than fluorinated alkyl group, methyl chloride, ethyl chloride, propyl chloride and butyl chloride are cited.

In the present invention, it is assumed that the fluorine atom number provides great function in providing the effect of uniform adherence on the fixing roller, by the use of the silicone oil substituted with alkyl, laminated with the fluorine-containing resin. In this occasion, the carbon atom number of fluorinated alkyl is 2 through 10 and preferably 2 through 8. A binding point directly with a silicone atom is preferably a methylenechain. When the above-mentioned fluorinated alkyl carbon number is too excessive, problems of fluidity properties occur, when heat is applied. In addition, when there is no fluorinated alkyl, there is no improvement in terms of wetability to the surface of the heat roll coated with the fluorine-containing resin so that a uniform oil layer cannot be formed.

Structures of typical specified examples of the fluorine-containing silicone oil will be shown as follows.

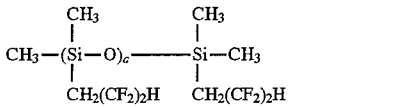

(1) Viscosity: 450 cs

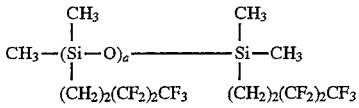

(2) Viscosity: 250 cs

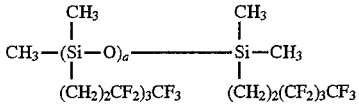

(3) Viscosity: 300 cs

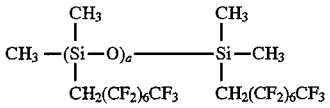

(4) Viscosity: 500 cs

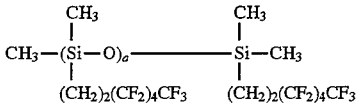

(5) Viscosity: 350 cs

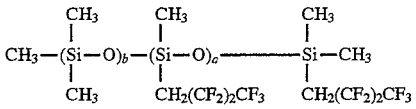

(6) Viscosity: 320 cs a:b = 80:20

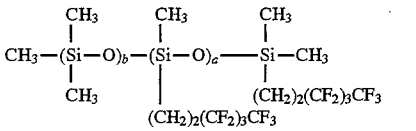

(7) Viscosity: 300 cs a:b = 60:40

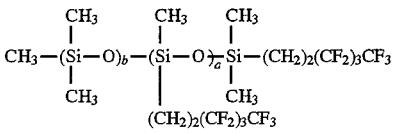

(8) Viscosity: 300 cs a:b =70:30

-continued

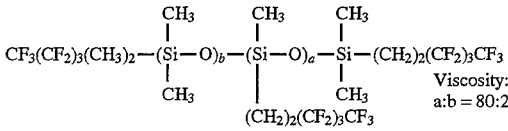

(9) Viscosity: 300 cs a:b = 80:20

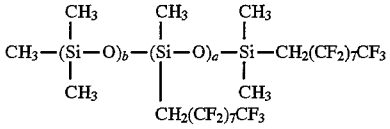

(10) Viscosity: 450 cs a:b = 50:50

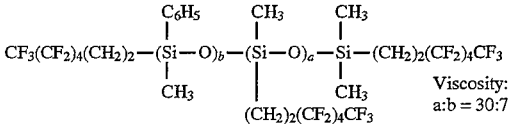

(11) Viscosity: 200 cs a:b = 30:70

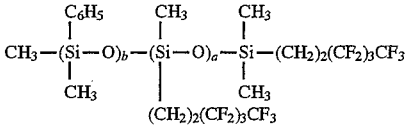

(12) Viscosity: 500 cs a:b = 90:10

Incidentally, in the above-mentioned compounds, a and b represent integers of 1 or more, preferably 10 through 2000 and more preferably 100 through 1000.

Toner of the present invention is composed of, at least, a resin and a colorant. In addition, if necessary, it is also composed of an additive such as a releasing agent. For a resin constituting the toner, there is no practical limit, and various conventional resins are usable. For example, styrene resins, acrylic resins, styrene-acrylic resins and polyester resins are cited. For a colorant constituting the toner, there is also no limit. For example, carbon black, nigrosine dyes, aniline blue, charcoal blue, chrome yellow, ultramarine blue, Du Pont oil red, quinoline yellow, methyleneblue chloride, phthalocyanine blue, Malachite Green oxalate and Rose Bengal are cited. As a releasing agent, low molecular weight polyolefines are used. As a low molecular weight polyolefin, polymers such as ethylene and propylene are used. Preferably, low molecular weight polypropylene, low molecular weight polyethylene and ethylene-propylene copolymers are cited. The above-mentioned additives preferably are added to the toner at 1 through 5 weight %. As other additives, for example, charge controlling agents such as salicylic acid derivatives and azo metallic complex are cited. In addition, when preparing magnetic toner, magnetic particles are contained in colored particles as additives. As a magnetic particle, particles such as ferrites and magnetites whose average primary particle size is 0.1 through 2.0 μm are used. The added amount of magnetic particles is 20 through 70% by weight of the colored particles.

From the viewpoint of providing fluidity, inorganic fine particles may be added. As an inorganic fine particle, inorganic oxidized product particles such as silica, titania and alumina are preferable. In addition, the above-mentioned inorganic fine particles are preferably subjected to hydrophobicity providing treatment by the use of a silane coupling agent and a titanium coupling agent.

The volume average particle size of the toner of the present invention is 5 through 10 μm. Specifically, it is necessary that 5 to 60% by number of toner particles is a particle size of not more than 5.04 μm. When volume the average particle size is 5 μm or less, development performance decreases so that it is difficult to obtain the necessary development toner amount. When the volume average particle size is 10 μm or more, the resolution becomes inferior. When the number of particles whose average particle size is 5.04 μm is 5 number % or less, the resolution at edge portions becomes so degraded that reproducibility of thin lines is poor. When the number of particles whose average particle size is 5.04 μm is 60 number % or more, development performance decreases, wherein development toner amount is insufficient and durability reduction is such that toner spent for the carrier and on the development sleeve occurs. Incidentally, the abovementioned average particle size and number % of toner are values measured by the use of COULTER Counter TA-II (produced by COULTER Inc.) under a condition that the aperture size is 100 μm.

In the present invention, a term "number %" means a ratio of a number of a toner particle having a specified particle size to the number of all toner particles.

The regulation of volume average particle size and the control particle size distribution can be controlled by classifying kneaded and crushed colored particles by the use of resins and colorants which constitute the toner. In addition, the manufacturing method of toner is not specifically limited. A polymerization method toner obtained by a polymerization mixture of a monomer and a colorant may be used in addition to the above-mentioned kneading, crushing and classifying method. In both methods, the regulation of the volume average particle size and the particle size distribution can be achieved by providing a classifying process.

The toner is mixed with carrier and used as a two-component developer, or when the toner is a magnetic toner, it is used as a one-component developer composed only of aforesaid magnetic toner. The carrier constituting the two-component developer may be either of a bare carrier constituted only by magnetic material particles such as iron and ferrite or a resin-coated carrier wherein the surface of each magnetic material particle is coated with resin. The average particle size of the carrier is preferably about 30 to 150 μm in terms of volume average particle size.

As preferable heat fixing methods used in the present invention, a heat roller fixing method and a fixing method by the use of a band-shaped film member are cited. In the band-shaped film fixing method, toner images are heated and fixed on a recording member by the use of a heating material which is mounted and fixed, a band-shaped film member moving along aforesaid heating material and a pressure member which faces the above-mentioned heating material and is in pressure contact therewith and rotates to bring the recording material into pressure contact with the heating member through the above-mentioned band-shaped film member.

Hereinafter, a heat fixing method preferably applied to the present invention will be explained.

The heat roller fixing method of the present invention will now be explained referring to FIG. 1. A fixing unit is formed by upper roller 1 having heating source 4 inside metallic cylinder 3, which is constituted of iron or aluminum, whose surface 2 is covered with tetrafluoroethylene or a polytetrafluoroethylene-perfluoroalkoxy vinyl ether copolymer, and lower roller 5 made of silicone rubber. Specifically, upper roller 1 has a bar-shaped heater as heating source 4 so that the surface of upper roller 1 is heated to about 120° to 200° C. Between this upper roller 1 and lower roller 5, recording material 6 which carries toner image 7 of the present invention is passed through so that toner image 7 is heat-fused and then fixed on recording material. According to conventional heat roller fixing methods, a portion of fused toner is disposed on upper roller 1 so that, after one rotation, offset phenomenon wherein the toner disposed on the above-mentioned upper roller 1 is stuck to another portion occurs. In addition, in extreme cases, a so-called rolling phenomenon wherein the toner fused onto the upper roller 1 is not separated from the recording material and rolls onto upper roller 1 together with the recording material, and in addition, the surface of the fixing roller becomes contaminated. At the fixing unit, pressure is applied between upper roller 1 and lower roller 5 so that lower roller 5 is deformed. Accordingly, a so-called "nip" is formed. The nip width is ordinarily 1 to 10 mm, and preferably 1.5 to 7 mm. Fixing line speed is preferably 40 to 400 mm/sec. When the nip width is too narrow, heat cannot be provided to toner uniformly, resulting in the occurrence of uneven fixing. On the contrary, when the nip width is too great, fusion of toner is promoted so that fixing off-set easily occurs.

In the heat roller fixing method of the present invention, the fluorine-containing silicone oil layer is formed on the surface 2 of upper roller 1. Due to interaction between this layer and toner of the present invention, many objects of the present invention are effectively attained. An example of forming the fluorine-containing silicone oil layer of the present invention on the surface 2 of upper roller 1 will be shown as follows.

Namely, coating roller 8 is brought into pressure contact longitudinal surface 2 of upper roller 1, and then, rotates in the arrowhead direction. Into the above-mentioned coating roller 8, the fluorine-containing silicone oil of the present invention is coated in advance, and when fixing, following the rotation of upper roller 1, the fluorine-containing silicone oil is gradually supplied to the surface of upper roller 1 in extremely small quantities from coating roller 8. As a result, on surface 2 of upper roller 1, the fluorine-containing silicone oil layer of the present invention is formed.

The band-shaped film member fixing method will now be explained referring to FIG. 2. Numeral 15, a line-shaped heating material with low heat capacity, which is fixed and supported on an apparatus, is alumina base board 17, on which a resistance material was coated at thickness of 1.0 to 2.5 mm, whose thickness is 0.2 to 5.0 mm and preferably 0.5 to 3.5 mm, the width is 10 to 15 mm and the length in the longitudinal direction is 240 to 400 mm. It is turned on electricity from both ends. An electric current of DC 100 V is flowed into the line-shaped heating materials 15 in the form of a pulse of 25 msec. in frequency in such a manner that the pulse width is modulated in accordance with the required amount of energy on the basis of the temperature measured by temperature sensor 16. Provided that temperature, sensed at line-shaped heating material 15 with low heat capacity, by means of temperature sensor 16, is T1, surface temperature T2 of band-shaped film member 14 which faces the resistance material is lower than T1. Here, T1 is preferably 120° to 220° C., Temperature of T2 is preferably lower than that of T1 by 0.5 to 10° C. Surface temperature T3 of band-shaped film member at a point where band-shaped film member 14 is peeled from the surface of the fixed toner is almost equivalent to T2. In the above-mentioned manner, band-shaped film member, after being brought into contact with the heated material, whose energy and temperature are controlled, moves toward the same direction as the recording member. The above-mentioned band-shaped film member 14 is a heat-resisting film, whose thickness is 10 to 35 μm, made of a polyester, polyperfluoroalkoxyvinyl ether, polyimide and polyether imide, covered with a releasing agent layer, whose thickness is 5 to 15 μm, wherein a conductive member is added to a fluorine resin such as Teflon, and is preferably formed of an endless film. Ordinarily, band-shaped film member 14, whose total thickness is 10 to 100 μm, is conveyed due to the driving and tension by means of driving roller 11 for the band-shaped film member and driven roller 12 for the band-shaped film member without wrinkling or crumpling. Pressure roller 13 has an elastic rubber layer having high releasing property such as silicone rubber. It provides a total pressure of 2 to 30 kg with low heat volume to line-shaped heating material 15 through band-shaped film member 14. The above-mentioned pressure member rotates in the arrowed direction while pressing on the line heated material. By passing the recording material, which carries the toner image, between the above-mentioned band-shaped film member 14 and pressure roller 13, the recording material is caused to pass through line-shaped heating material 15 at low heat volume, and thereby the toner image is caused to be heat-fixed onto the recording material.

Figure 2:
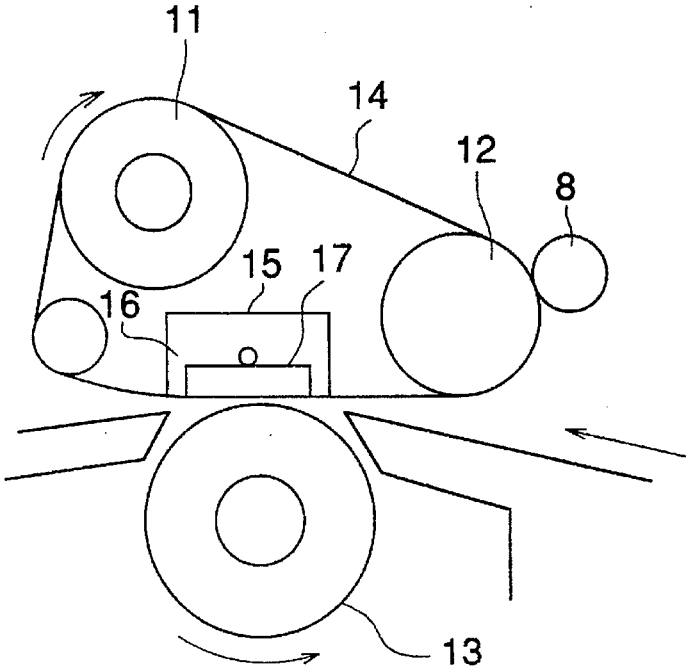
FIG. 2 is a drawing showing an example of schematic structure of a heat fixing method of another example of the present invention wherein a heating material and a recording material are brought into contact through a band-type film member.

In FIG. 2, in the same manner as in FIG. 1, coating roller 8, , is brought into pressure contact with film driven roller 12, through the longitudinal direction of band-shaped film member 14 and then, rotates toward the arrowed direction. In FIG. 2, following the shift of band-shaped film member 14, the fluorine-containing silicone oil is gradually supplied to the surface of band-shaped film member 14 in extremely small quantities from coating roller 8. As a result, on the surface of pressure roller 13 side of band-shaped film member 14, the fluorine-containing silicone oil layer of the present invention is formed.

Another example of the band-shaped film member fixing method will be explained, referring to FIG. 3. While the above-mentioned example of FIG. 2 uses an endless band-shaped film member, FIG. 3 uses an double-ending band-shaped film member.

Namely, as shown in FIG. 2, double-ending band-shaped film member 24 is wound onto sheet feeding shaft 21 and winding shaft 22. Following fixing, band-shaped film member 24 is caused to be gradually shifted in the arrowed direction. In this occasion, the above-mentioned band-shaped film member is driven by winding shaft 22. Numerals 13, 15, 16 and 17 are identical to those in FIG. 2.

Double-ending band-shaped film member 24, which is wound to sheet feeding shaft 21 by winding shaft 22, is wound up gradually, following fixing. Between double-ending band-shaped film member 24 and pressure roller 13, a recording member, which carries the toner image is passed. Thus, toner images are fused-fixed on a recording member.

Figure 3:
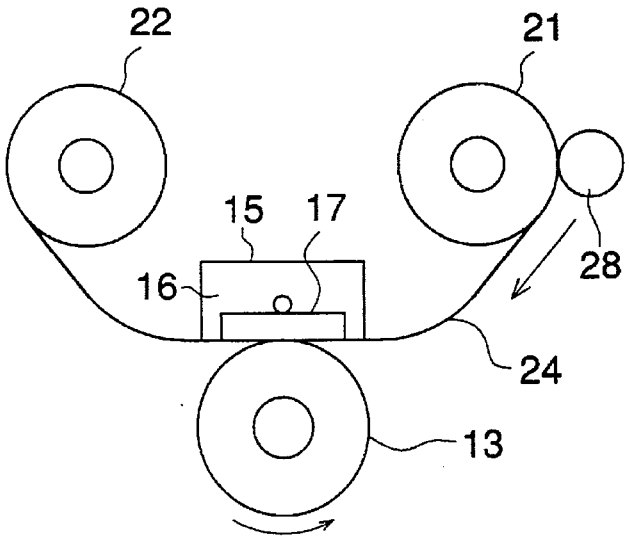
FIG. 3 is a drawing showing a modified example of the fixing method of the band-shaped film member as shown in FIG. 2.

In FIG. 3, coating roller 28 wherein the fluorine-containing silicone oil of the present invention is coated is brought into pressure contact sheet feeding shaft 21 through double-ending band-shaped film member 24 so that the fluorine-containing silicone oil layer of the present invention is formed on the surface of the pressure roller side of the double-ending band-shaped film member.

In the illustrated example, a method of forming the fluorine-containing silicone oil layer using coating roller was disclosed. In addition, a pad or a web wherein the fluorine-containing silicone oil is coated may be used.

Hereunder, examples of the present invention will be exhibited. However, the present invention is not limited thereto.

EXAMPLE 1

Example of Manufacturing Toner 100 parts of polyester resin (PEs), 5 parts of carbon black and 3 parts of the low molecular weight polypropylene were added, fused and kneaded. Next, the resulting mixture was crushed by the use of a machine type crusher, and then, classification operation was conducted by means of an air-flow type classifier to obtain colored particles. In this occasion, crushing and classifying conditions were appropriately controlled so that the volume average particle size and grading distribution of the colored particles were prepared.

In addition, 100 parts of styrene-acrylic resin (St-AC), 5 parts of carbon black, 3 parts of the low molecular weight polypropylene and 1 part of charge controlling agent composed of an azo-type metallic complex were added to obtain colored particles in accordance with the above-mentioned method.

In addition, by the use of styrene and butyl acrylate, carbon black was dispersed. Following this, the mixture was suspended in water so that polymerized colored particles composed of a styrene-acrylic resin were obtained by means of a so-called suspension polymerization method. In this occasion too, dispersion conditions in suspension polymerization were controlled. In addition, by providing the classification process as necessary, the volume average particle size and grading distribution were controlled.

Next, to the above-mentioned colored particles, hydrophobic silica was added at a ratio of 0.8% to obtain toner of the present invention. Table 1 shows a list of the above-mentioned toners.

TABLE 1

| Name of toner | Production method | Binder resin | Volume average particle size (μm) | 5.04 μm or less (number %) |
|---|---|---|---|---|
| Toner 1 | Crushing method | PEs | 8.6 | 20 |
| Toner 2 | Crushing method | PEs | 6.5 | 33 |
| Toner 3 | Crushing method | PEs | 8.5 | 14 |
| Toner 4 | Crushing method | St-Ac | 8.5 | 26 |
| Toner 5 | Crushing method | St-Ac | 5.3 | 47 |
| Toner 6 | Polymerization method | St-Ac | 9.5 | 18 |
| Toner 7 | Polymerization method | St-Ac | 8.1 | 24 |
| Toner 8 | Polymerization method | St-Ac | 5.9 | 21 |
| Comparative toner 1 | Crushing method | PEs | 10.6 | 4 |

TABLE 1-continued

| Name of toner | Production method | Binder resin | Volume average particle size (μm) | 5.04 μm or less (number %) |
|---|---|---|---|---|
| Comparative toner 2 | Crushing method | PEs | 4.7 | 67 |
| Comparative toner 3 | Crushing method | St-Ac | 11.2 | 1 |
| Comparative toner 4 | Polymerization method | St-Ac | 4.5 | 78 |

Corresponding to each toner listed above, ferrite carrier, coated with a styrene-acrylic resin, whose volume average particle size of 62 μm was mixed and developing agent having a toner density of 7% by weight were prepared.

For evaluation of the above-mentioned toners on image quality and anti-offset performance, an evaluating machine which was the same as an image forming device wherein a copying machine 3035 produced by Konica Corporation was modified and a fixing device shown in FIG. 1 were used. Specification of the fixing device is shown below.

As a heat roller fixing device, one wherein there was a upper roller of 30 mm diameter, whose surface 2 was covered with a tetrafluoroethylene-perfluoroalkyl vinyl ether copolymer, composed of cylindrical iron, integrally housing a heater 4 in its interior central portion and there was also a lower 30 mm diameter roller constituted of silicone rubber whose surface was covered with a tetrafluoroethylene-perfluoroalkylether copolymer. Line pressure was set at 0.8 kg/cm, and nip width was 4.3 mm. By the use of the abovementioned fixing device, the printing line speed was set at 250 mm/sec. Incidentally, as a cleaning mechanism of the fixing device, coating roller 8 wherein fluorine-containing silicone oil of the present invention is coated was mounted and used. As the above-mentioned fluorine-containing silicone oil, illustrated compounds (3), (7), (8) and (10) were used. A band-shaped film type fixing device respectively using the illustrated compounds (3), (7), (8) and (10) were defined to be R-1, R-2, R-3 and R-4. For the fixing device, one whose surface temperature of upper roller 1 was varied (110° through 230° C.) was used. The fixing device was evaluated under the following criteria. Table 3 shows the results thereof.

The specification of the band-shaped film-type fixing device was as follows.

As the fixing apparatus, an endless sheet fixing device (a band-shaped film-type fixing device) shown in FIG. 2 was used, and fixing conditions were set as follows.

Fixing conditions:

Temperature T1 of a heating member 15=110° to 230° C.

Speed of the film material 14=250 mm/sec.

Total pressure between the heating material 15 and the pressure roller 13=15 kg Nip width between the pressuring roller 13 and the film material 14=3 mm The film material 14: a polyimide film, covered with polytetrafluoroethylene wherein conductive material was dispersed on its surface, whose thickness was 15 μm.

Incidentally, as a cleaning mechanism of the fixing device, coating roller 8 wherein fluorine-containing silicone oil of the present invention is coated was mounted and used. As the above-mentioned fluorine-containing silicone oil, illustrated compounds (3), (7), (8) and (10) were used. A band-shaped film-type fixing device respectively using the illustrated compounds (3), (7), (8) and (10) were defined to be F-1, F-2, F-3 and F-4.

For comparison, one wherein a silicone oil composed of dimethylpolysiloxane (a dimethylsilicone oil) was coated in the above-mentioned coating roller 8 and one wherein fluorine-containing silicone oil (FS-1265: produced by Dow Corning Inc.) in which a side-chained fluorinated alkyl described in Japanese Patent O.P.I. Publication No. 124338/1977 is a mere trifluoromethyl was coated into coating roller 8 were used. The heat roller fixing device using the dimethylsilicone oil was defined to be R-Comp. 1 and the film-type fixing device was defined to be F-Comp. 1. Those using the fluorine-containing silicone oil outside the scope of the present invention were defined to be R-Comp. 2 and F-Comp. 2. These were evaluated in accordance with the following criteria. Table 4 shows the results thereof.

Evaluation of performance

Evaluation on image quality

Resolution of copied images obtained by the use of the above-mentioned evaluation machine was evaluated by means of reproducibility of thin lines. The number of thin lines per 1 mm which can be identified visually was investigated.

Evaluation on developability and durability

By the use of the evaluation machine, and under high temperature and high humidity conditions (30° C./80%RH), an image whose pixel ratio was 5% was continuously copied for 30,000 copies, and then, the initial toner image and a toner image after 30,000 copies of copying were compared. As a comparative sample, a solid black image whose density was 1.6 in terms of absolute density was printed so that the reflection density was measured. For reflection density measurement, an RD-918 produced by Macbeth Inc. was used. The images were evaluated by means of relative density wherein the density of paper was defined to be 0. Table 2 shows the results of the comparison of the toner images.

Evaluation of anti-offset property

By the use of the evaluation machine having the respective fixing device constitution, the anti-offset property was evaluated. For evaluation, an image having a 5 cm grid, at the edges, each 5 mm corner having 0.2 mm width line was prepared and transferred onto a recording paper. Then, by the use of the above-mentioned recording paper, the resulting image was fixed by means of the above-mentioned fixing unit. The temperature of the fixing member was gradually raised to find the temperature at which a part of grid image printed at the leading edge is offset. Image defects were thus investigated.

Tables 2, 3 and 4 collectively show the results of the above-mentioned performance evaluation.

TABLE 2

| Toner name | Resolution lines/mm | Image Density Initial | Image Density After 30,000 copies |
|---|---|---|---|
| Toner 1 | 6.0 | 1.35 | 1.33 |
| Toner 2 | 6.0 | 1.35 | 1.34 |
| Toner 3 | 5.5 | 1.36 | 1.35 |
| Toner 4 | 6.0 | 1.36 | 1.36 |
| Toner 5 | 6.0 | 1.37 | 1.36 |
| Toner 6 | 5.5 | 1.35 | 1.34 |
| Toner 7 | 6.0 | 1.35 | 1.34 |
| Toner 8 | 6.0 | 1.35 | 1.33 |
| Comparative toner 1 | 3.5 | 1.36 | 1.33 |
| Comparative toner 2 | 6.0 | 1.37 | 1.17 |
| Comparative toner 3 | 3.0 | 1.35 | 1.34 |
| Comparative toner 4 | 6.0 | 1.35 | 1.17 |

TABLE 3

| Toner name | Temperature at which off-set occurred (°C.) R-1 | R-2 | R-3 | R-4 | R-comp. 1 | R-comp. 2 |
|---|---|---|---|---|---|---|
| Toner 1 | 230 | 230 | 230 | 230 | 180 | 180 |
| Toner 2 | 225 | 225 | 225 | 225 | 170 | 170 |
| Toner 3 | 230 | 230 | 230 | 230 | 185 | 185 |
| Toner 4 | 230 | 230 | 230 | 230 | 180 | 180 |
| Toner 5 | 230 | 230 | 230 | 230 | 175 | 175 |
| Toner 6 | 230 | 230 | 230 | 230 | 180 | 180 |
| Toner 7 | 230 | 230 | 230 | 230 | 180 | 180 |
| Toner 8 | 225 | 225 | 225 | 225 | 175 | 175 |
| Comparative toner 1 | 230 | i3O | 230 | 230 | 180 | 180 |
| Comparative toner 2 | 215 | 215 | 215 | 215 | 160 | 160 |
| Comparative toner 3 | 230 | 230 | 230 | 230 | 185 | 185 |
| Comparative toner 4 | 220 | 220 | 220 | 220 | 165 | 165 |

TABLE 4

| Toner name | Temperature at which off-set occurred (°C.) F-1 | F-2 | F-3 | F-4 | F-comp. 1 | F-comp. 2 |
|---|---|---|---|---|---|---|
| Toner 1 | 230 | 230 | 230 | 230 | 180 | 185 |
| Toner 2 | 225 | 225 | 225 | 225 | 170 | 175 |
| Toner 3 | 230 | 230 | 230 | 230 | 185 | 185 |
| Toner 4 | 230 | 230 | 230 | 230 | 180 | 185 |
| Toner 5 | 230 | 230 | 230 | 230 | 175 | 180 |
| Toner 6 | 230 | 230 | 230 | 230 | 180 | 185 |
| Toner 7 | 230 | 230 | 230 | 230 | 180 | 185 |
| Toner 8 | 225 | 225 | 225 | 225 | 175 | 180 |
| Comparative toner 1 | 225 | 225 | 225 | 225 | 175 | 180 |
| Comparative toner 2 | 210 | 210 | 210 | 210 | 160 | 160 |
| Comparative toner 3 | 225 | 225 | 225 | 225 | 175 | 180 |
| Comparative toner 4 | 215 | 215 | 215 | 215 | 160 | 160 |

From Tables 2 through 4, due to the present invention, an image forming method wherein durability is improved, high image quality is achieved and the occurrence of fixing off-set is prevented, can be provided.

Owing to the present invention, an image forming method wherein no offset phenomenon occurs through a wide fixing temperature range, durability is improved and high image quality is attained.

An example of the image forming apparatus capable of using toner and the fluorine-containing silicone oil which attain the first object of the present invention will be explained referring to a copying apparatus shown in FIG. 4.

Figure 4:
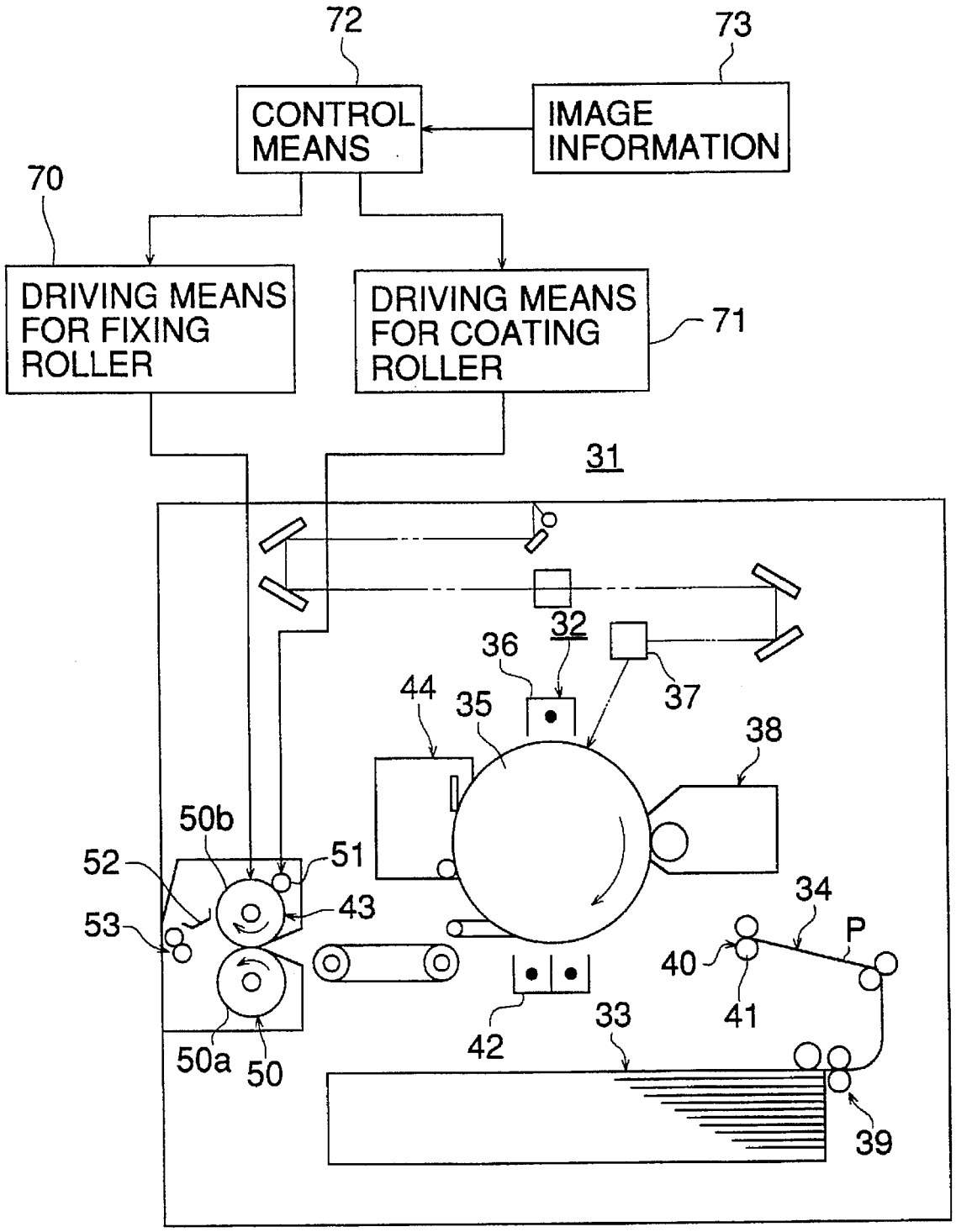
FIG. 4 is a schematic diagram of an image forming apparatus equipped with a fixing device.

In the copying apparatus shown in FIG. 4, the heat fixing roller is used as a fixing device. The constitution of the fixing device which attains the second object of the present invention will be explained referring to this heat fixing roller.

Copying device 31 is provided with image forming unit 32, paper feeding unit 33 and conveyance path 34. In image forming unit 32, photoreceptor drum 35 is provided as an image carrier member. Photoreceptor 35 is provided with uniform electric charging by means of electrodes 36 for electric charging. By means of original exposure means 37, image information is irradiated on the circumferential surface of charged photoreceptor drum 35 so that a static latent image is formed. The static latent image is developed by developing unit 38 so that a toner image is formed.

By means of feeding device 39, a recording material such as a transfer paper and an OHP sheet is fed from paper feeding unit 33 into conveyance path 34. Recording material P temporarily stops at waiting portion 40 provided in conveyance path 34, and then, in synchronization with the rotation of photoreceptor drum 35, conveyance roller 41 in waiting portion 40 is driven. Recording material is fed to transferring unit 42 so that a toner image is transferred. Following this, recording material P is separated from photoreceptor drum 35, and then, is conveyed to the next process, i.e., fixing device 43. In addition, at the circumference of photoreceptor drum 35, cleaning unit 44 is provided, which cleans the surface of photoreceptor drum 35. For the next image formation, the photoreceptor drum is charged again by means of electrodes 36 for electric charging.

Recording material P, heated and pressed in fixing device 43, fixes a toner image. Fixing device 43 is provided with a pair of fixing rollers 50, coating roller 51, guide 52 and a pair of exiting rollers 53. A pair of fixing rollers 50 is composed of lower roller **50*a* and upper roller 50*b*, which makes a pair with the upper roller. The above-mentioned lower roller 50*a* and upper roller 50*b*** rotate in the arrowed direction.

Between a paired fixing rollers 50, recording medium P such as a transcription paper, an OHP sheet and an envelopes passes, and then, a toner image formed on recording material P is heated and fixed. On the surface of upper roller **50*b*, coating roller 51, which is a means for coating oil is provided. Coating roller 51 uniformly coats oil onto the surface of upper roller 50*b*. Recording medium P, which exits from the paired fixing rollers 50 is fed to paired exiting rollers 53 by means of guide 52. By means of a pair of exiting rollers 53**, recording medium P wherein the image is fixed is ejected.

In the above-mentioned fixing device, a pair of fixing rollers 50 is driven by fixing roller driving means 70. Coating roller 51 is driven by coating roller driving means 71. Fixing roller driving means 70 and coating roller driving means 71 are independently driven by control means 72. While recording material P, sandwiched by a pair of fixing rollers 50, passes between the above-mentioned paired fixing rollers 50, the toner image is heat-fused at about 200° C. so that it is fixed on recording material P.

In the above-mentioned fixing operation by means of a pair of fixing roller 50, oil, for example a silicone oil is supplied onto upper roller **50*b* from coating roller 51. Since this oil has high affinity to resin layer 50*b*3, it is uniformly coated onto the surface of upper roller 50*b* so that the peeling property when recording material P is exited from the pair of fixing rollers 50** becomes extremely superior.

Control means 72 controls the coating amount of coating roller 51 based on image information 73 which forms a toner image on recording medium P.

Next, a practical structure of the fixing apparatus will be explained.

Figure 5:
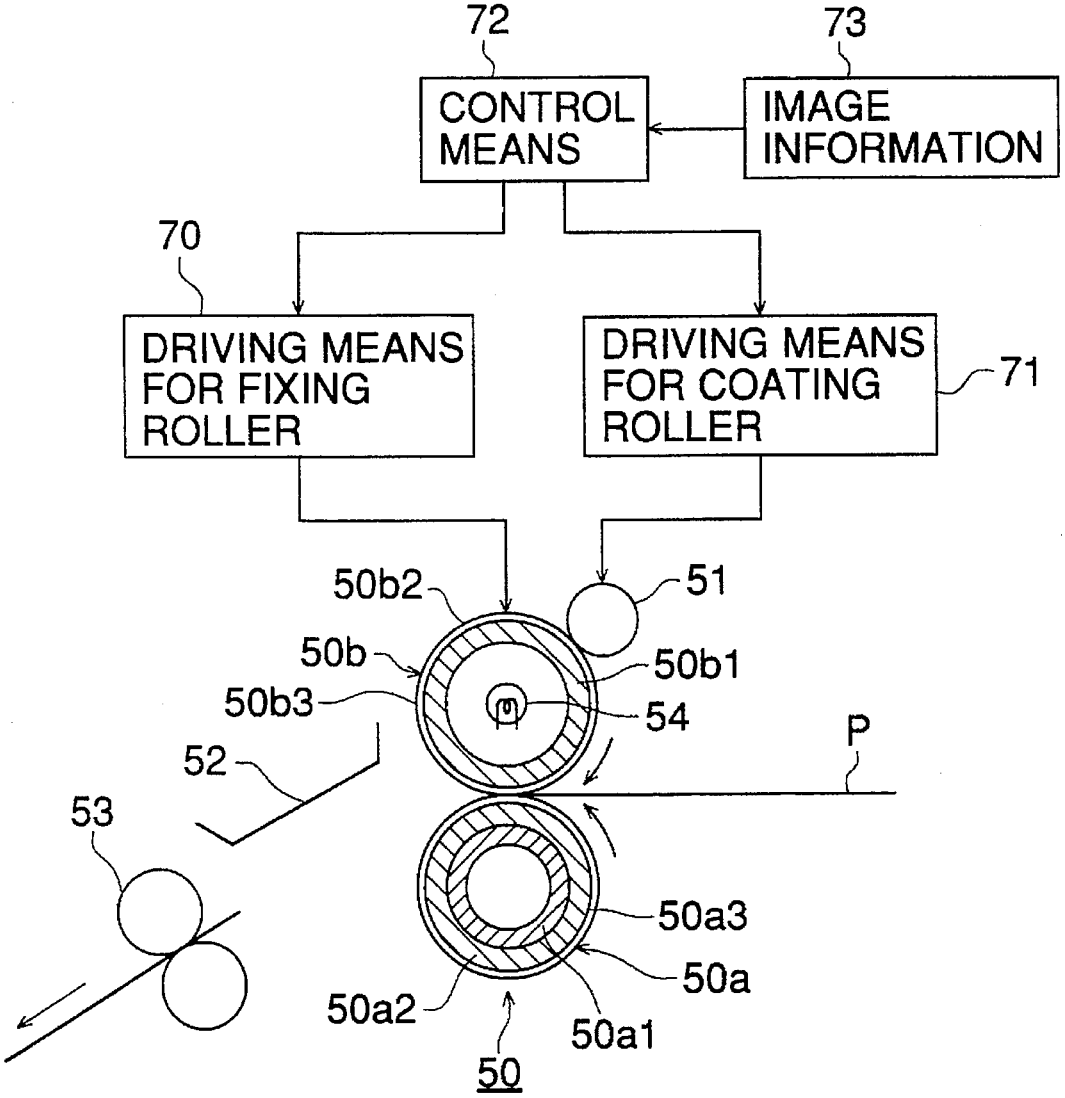
FIG. 5(*a*) through 5(*c*) are diagrams of the fixing device.
Figure 5:
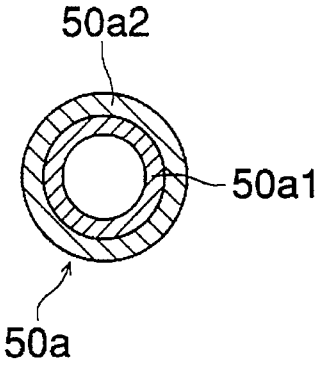
Figure 5:
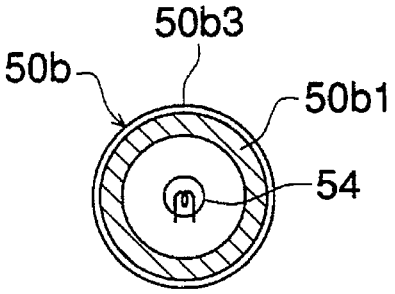

Lower roller **50*a* is, as shown in FIG. 5**(*a*), composed of a base tube **50*a*1 on which silicone rubber layer 50*a*2 and resin layer 50*a*3 are coated in that order. Resin layer 50*a*3 is composed of a PFA or PTFE resin. Lower roller 50*a* is, as shown in FIG. 5**(*b*), composed of base tube **50*a*1 on which silicone rubber layer 50*a*2** is laminated. The surface resin layer maybe omitted.

Upper roller **50*b* is, as shown in FIG. 5**(*a*), composed of base tube **50*b*1 on which silicone rubber layer 50*b*2 and resin layer 50*b*3 are coated. Inside base tube 50*b*1, heater 54 is provided so that the surface of upper roller 50*b*** is heated to in the vicinity of 200° C.

In addition, upper roller **50*b* is, as shown in FIG. 5**(*c*), composed of base tube **50*b*1 on which resin layer 50*b*3 is coated. A silicone rubber layer may be omitted. In the same manner as for the lower roller, resin layer 50*b*3 is composed a PFA or PTFE resin. As described above, a resin layer may be provided on upper roller 50*b* which contacts the toner image. However, as shown in FIG. 2**(*a*), the resin layer may be provided on both the upper roller **50*b* and the lower roller 50*a***.

In the present invention, the heat resistance of upper roller **50*b* is set in a range of 2.5 through 7.9 cm·s·deg/cal. The roller hardness of lower roller 50*a*** is set to be within ±5° of the hardness of the upper roller.

The heat resistance of upper roller **50*b* is the sum of the resistance of the resin layer and that of an elastic layer. For example, in the case when resin layer 50*b*3 is composed of a fluorine resin layer, its heat resistance is 0.89 cm·s·deg/cal. The heat resistance of the elastic layer composed of silicone rubber layer 50*b*2** is calculated by the following equation 1.

Equation 1

$$\frac{\ln\left[\frac{R1}{R2}\right]}{2\pi\lambda}$$

wherein R1: outer radius of the elastic layer [mm]

R2: inner radius of the elastic layer [mm]

λ: heat conductivity of the elastic layer [cal/cm·s·deg]

As shown in Table 1, by changing the outer radius of the elastic layer, the inner radius of the elastic layer and the thickness of the elastic layer, samples (1), (2) and (3) were prepared and the heat resistance of each of them were calculated.

TABLE 5

| Sample | R1 | R2 | Thickness | γ | Heat resistance in the elastic layer | Heat resistance in the fluorine-containg resin layer | Heat resistance in the upper roller |
|---|---|---|---|---|---|---|---|
| (1) | 14.95 | 14.8 | 0.15 | $1 \times 10^{-8}$ | 1.6 | 0.89 | 2.5 |
| (3) | ↑ | 14.86 | 0.09 | $1 \times 10^{-8}$ | 1.0 | 0.89 | 1.9 |
| (2) | ↑ | 14.3 | 0.65 | $1 \times 10^{-8}$ | 7.1 | 0.89 | 8.0 |

As shown in Table 5, the heat resistance of the upper rollers of the samples (1), (2) and (3) is the sum of the heat resistance of the fluorine containing resin layer and that of the elastic layer. In addition, as shown in FIG. 6, the temperature of the upper rollers of the above-mentioned samples (1), (2) and (3) were changed so that the transmission rate of the toner image was measured.

Figure 6:
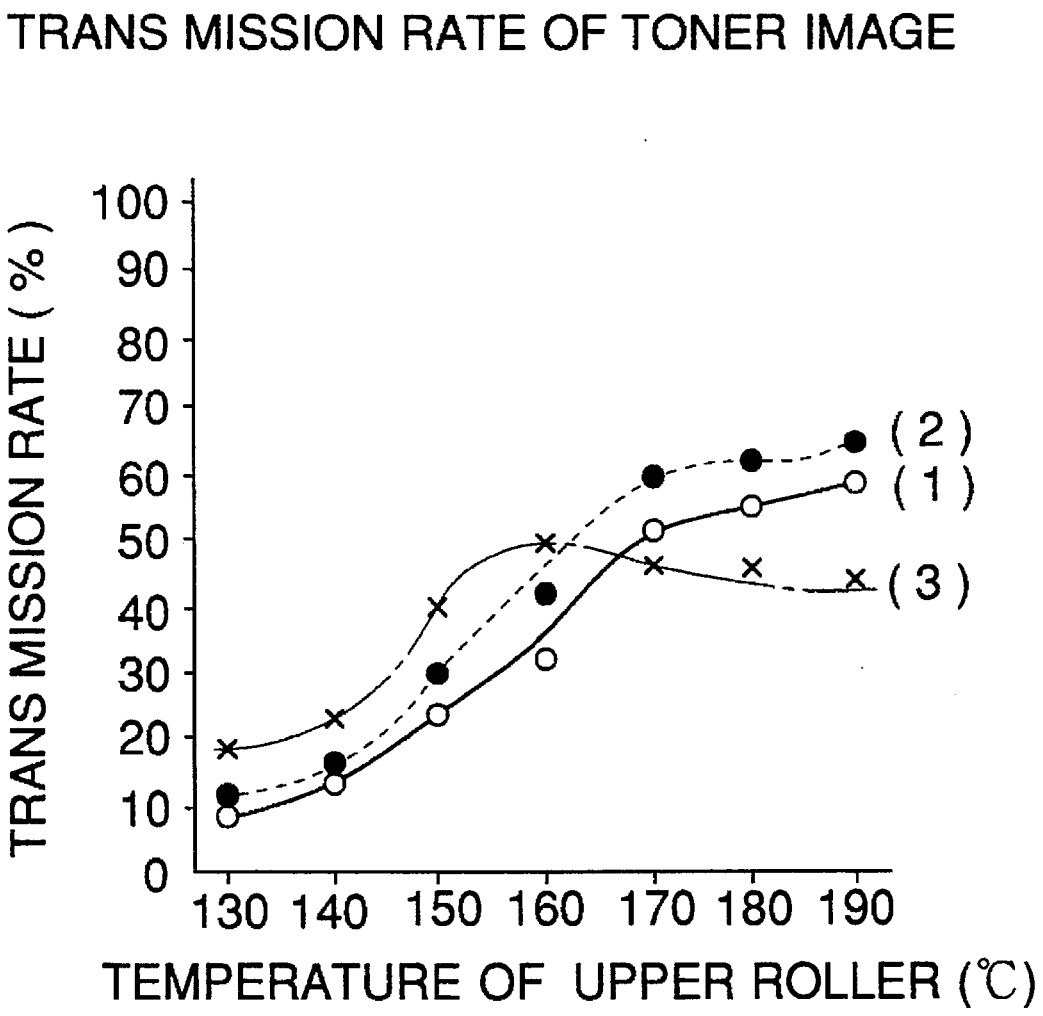
FIG. 6 is a drawing showing the relationship between the temperature of the upper roller and the toner image transmission rate.

As a result, in the case of the sample (3) wherein the heat resistance of the upper roller **50*b* is 2 cm·s·deg/cal or less, the transmission rate on the high temperature side is reduced, as shown in FIG. 6**. Therefore, the lower limit of the heat resistance is 2.5 cm·s·deg/cal.

On the other hand, when the heat resistance increases excessive, the temperature fluctuation of the upper roller surface also becomes excessive. As a result, there may be some cases when the toner cannot be fixed onto recording material P sufficiently on the low temperature side. In the case of sample (2), the fixing performance was close to the lower limit. Accordingly, the upper limit of the heat resistance was 7.9 cm·s·deg/cal.

As described above, the sum of the heat resistance of the silicone rubber layer and that of the fluorine containing resin layer of the upper layer is, as described above, set in a range of 2.5 through 7.9 cm·s·deg/cal.

Namely, the color property of the color transmitting image (an OHP sheet) is dependent on the flatness of the surface of the toner image. Since the unevenness of the surface of the toner image scatters or refracts the transmitting light, the projected image darkens (in the worse case, becomes totally black). Therefore, toner surface after fixing is necessary to be flat.

The higher to some extent (in other words, compared to a conventional fixing roller) the heat resistance in the outside layer of the base tube (core metal) of the fixing roller is, the better the on the flatness of the toner surface tends to be.

Other comparative data regarding the roller heat resistance and the light transmission rate of the transmitting image is shown as follows.

[Conventional roller]

It has a fluorine resin in the surface layer. There is no silicone layer.

Thickness of the fluorine containing resin layer: 50 μm

Heat conductivity λ: 0.6 [$10^{-3}$ cal/(cm·s·deg/cal)]

Outer diameter of the roller: ϕ30 mm

Heat resistance calculation: $\lambda=0.6\times10^{-3}$

Figure 7:
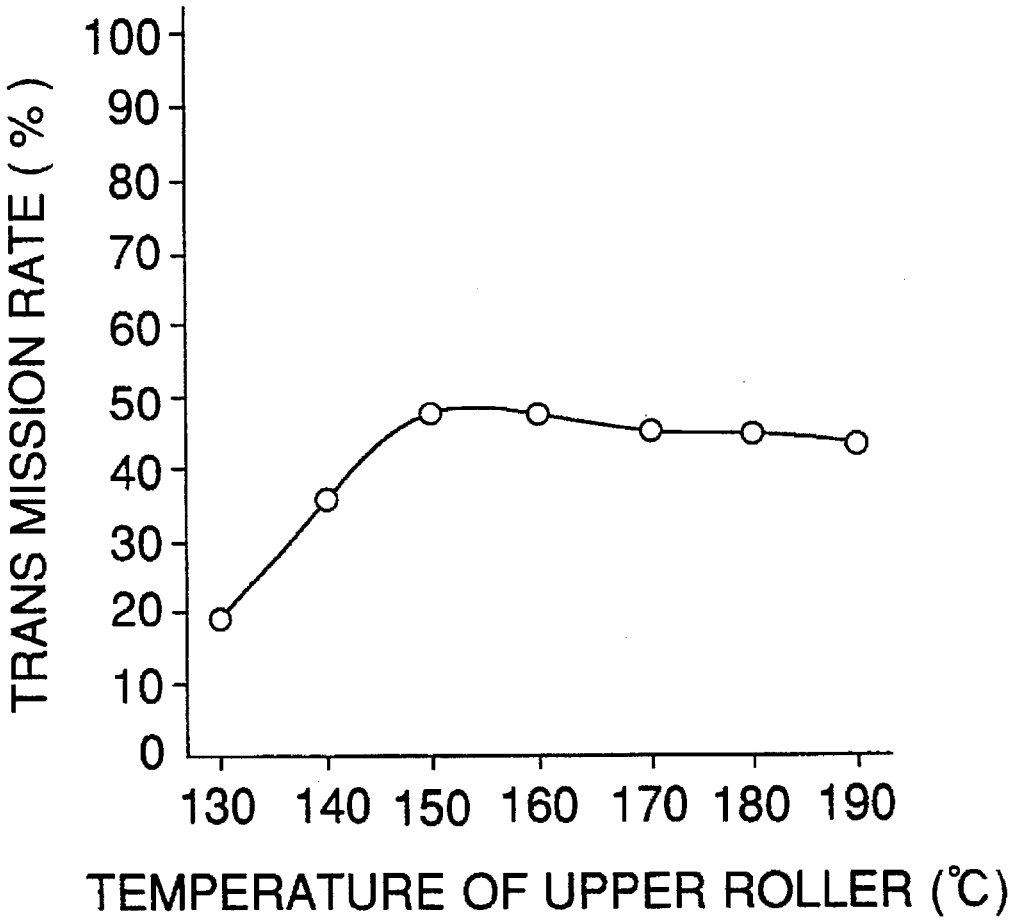
FIG. 7 is a drawing showing toner image transmission rate of the conventional fixing roller.

Equation $$\frac{1n(15\text{ mm}/14.95\text{ mm})}{2\pi\lambda}=0.89$$

when the above-mentioned conventional roller is employed, toner image transmission rate is shown in FIG. 7.

[Inventive roller]

It has a fluorine resin in the surface layer, and also has a silicone rubber layer.

Thickness of the fluorine resin layer: 50 μm

Heat conductivity λ: 0.6 [$10^{-3}$ cal/(cm·s·deg/cal)]

Thickness of the silicone rubber layer: 0.5 mm

Heat conductivity λ: 1.0 [$10^{-3}$ cal/(cm·s·deg/cal)]

Outer diameter of the roller: ϕ30 mm

Heat resistance calculation: $\lambda=0.6\times10^{-3}$ $$\frac{1n(15\text{ mm}/14.95\text{ mm})}{2\pi\lambda}=0.89$$

Figure 8:
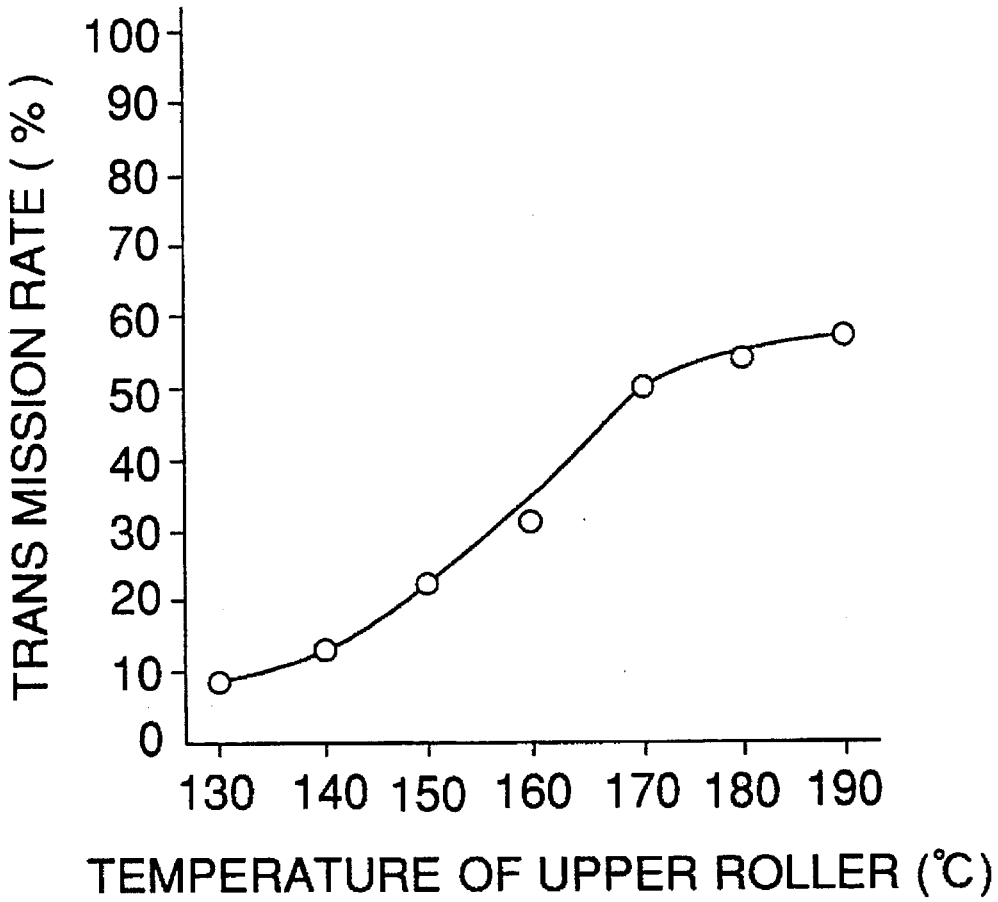
FIG. 8 is a drawing showing toner image transmission rate of the fixing roller employed in Examples of the present invention.

Heat resistance calculation (of the silicone rubber layer):

$\lambda = 1.0\times10^{-1}$ $$\frac{1n(14.95\text{ mm}/14.8\text{ mm})}{2\pi\lambda}=5.41$$

$$0.89+5.41=6.3$$

when the above-mentioned inventive type roller is employed, toner image transmission rate is shown in FIG. 8.

When comparing the conventional type roller and the inventive type roller, the following differences are observed.

In the case of the conventional roller, as shown in FIG. 7, the transmission rate is increased to some extent up to 150° C. However, when the temperature is raised above this, the transmission rate. When the toner image is observed by means of a microscope, at 150° C. or less, the toner particles are melted along with the ambient toner from an independent status as the temperature is raised. However, at 160° C. or more, unevenness of the surface of the completely melted toner is extended.

In case of the inventive roller, as shown in FIG. 8, the transmission rate is increased up to 190° C. The transmission rate of the inventive roller is higher than that of the conventional roller. When the toner image is observed with a microscope, though the toner particles are melted along with the ambient toner from an independent status. However, the occurrence of unevenness, as in the conventional type, is not shown at 190° C. or less.

The above-mentioned phenomenon can be regarded as follows.

The toner of the conventional roller becomes molten at a lower temperature. The reason for this is that the transmission speed of heat from the fixing roller to the toner is higher since the heat resistance of the conventional roller is less.

In addition, the reason for that the maximum value of the transmission rate of the conventional roller is lower is due to the unevenness of the surface, which starts to occur before the lower layer (closer to the OHP sheet) of the toner has finished melting. In the case of the inventive example, the unevenness on the surface is difficult to occur until the lower layer of the toner has finished melting since the transmission of heat is slow. Therefore, the transmission rate is raised to a higher temperature (190° C.).

It can also be considered that the reason for the occurrence of the unevenness of the surface of the toner is that the visco-elasticity of the toner is reduced as the temperature is raised and thereby the toner is drawn due to the adhesive strength with the fixing roller. cm·s·deg/cal.

Accordingly, conventional rollers wherein heat transmission is too low cannot attain sufficient toner image transmission rate. Desirable heat resistance is, as described above, 2.5 through 7.9 cm·s·deg/cal. When the heat resistance is too large, it goes without saying that adhesive property between the toner and transcription paper sheet in ordinary copying becomes insufficient.

The thickness "$t_u$" of silicone rubber layer **50*b*2 on upper roller 50*b* is set in a range of 0.2 through 1 mm. The thickness "$t_s$" of silicone rubber layer 50*a* of lower roller 50*a*** is set to 0.5 through 2 mm. In addition, it is set as follows:

$t_s-2<(15/8)\times(t_u-1)$.

In order to prevent the occurrence of wrinkling, the hardness difference between the upper roller and the lower roller must be within ±5°. An example of rollers structure wherein the hardness difference of the upper roller and the lower roller being within ±5° is shown below.

Rubber hardness of the elastic layer: JIS-A 40° C.

Fluorine containing resin in the surface layer: 50 μm thickness

Figure 9:
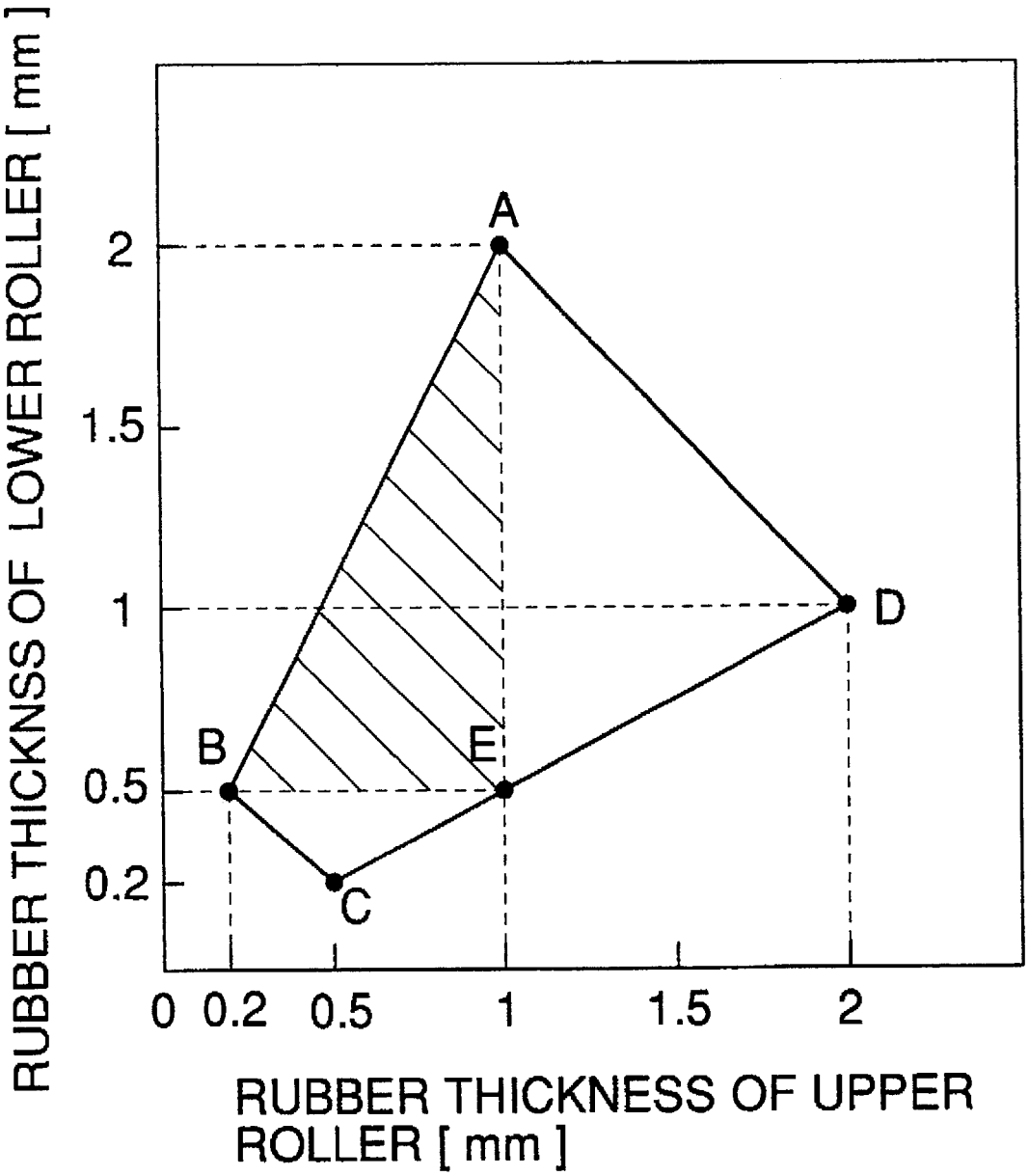
FIG. 9 is a drawing showing a suitable range of the difference of hardness between the upper roller and the lower roller.

The hardness (Aska C) of the upper roller and the lower roller at measuring points A, B, C and D in FIG. 9 is shown in Table 6.

TABLE 6

| | Upper roller | | Lower roller | | |
|---|---|---|---|---|---|
| Measured point in FIG. 9 | Rubber thickness mm | Hardness ° | Rubber thickness mm | Hardness ° | Difference of hardness |
| A | 1 | 86 | 2 | 81 | +5 |
| B | 0.2 | 96 | 0.5 | 91 | +5 |
| C | 0.5 | 91 | 0.2 | 96 | −5 |
| D | 2 | 81 | 1 | 86 | −5 |

The range of hardness difference between the upper roller and the lower roller is ±5° is within the limits of measured points A, B, C and D.

With regard to the upper roller in which a heater is housed internally, since the temperature at the interface between the core metal and the rubber layer is increased, the thicker the rubber layer is, the more the adhesive layer in the above-mentioned border is deteriorated due to heat. Accordingly, when the used temperature is 180° C., the limit of the rubber thickness of the upper roller is assumed to be 1 mm. On the other hand, when the thickness of the rubber of the lower roller is 0.5 mm or less, sufficient width of the fixing nip cannot be attained. Therefore, the fixing becomes insufficient. Accordingly, an appropriate range of hardness difference between the upper roller and the lower roller is inside a triangle composed of measured points A, B and E.

Next, a comparative test for regarding the hardness difference between the upper roller and the lower roller will be explained.

Roller hardness: shown by means of Aska C hardness.

Aska C test

Asuka C test is for testing the hardness of the object.

Figure 14:
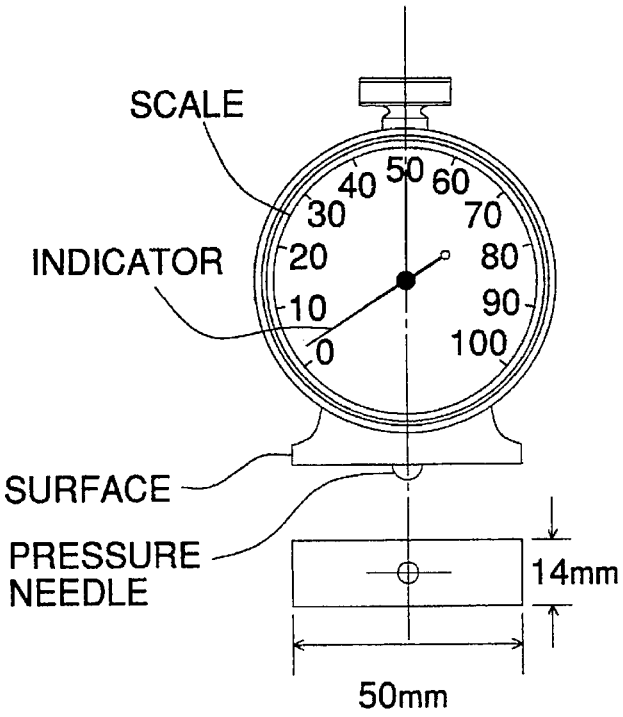
FIGS. 14(*a*) to 14(*c*) are drawings of Asuka C hardness measuring device.
Figure 14:
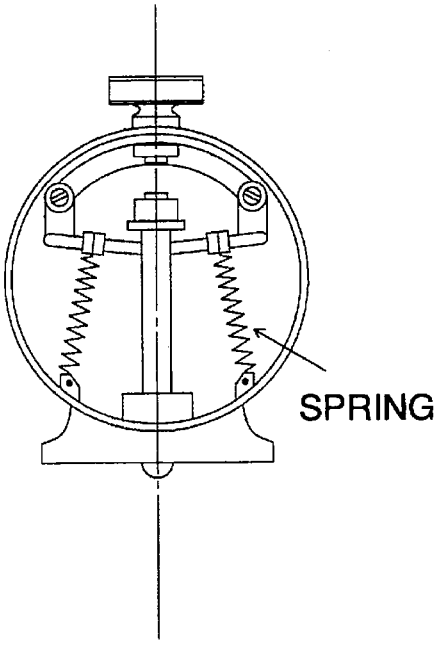
Figure 14:
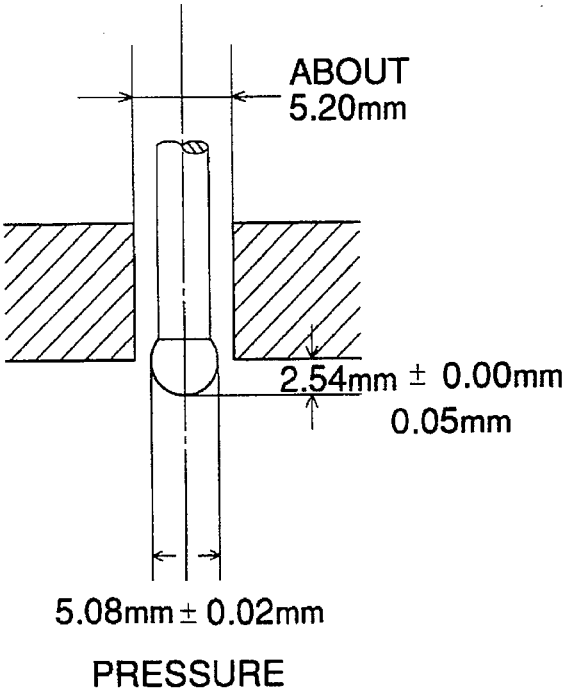

As shown in FIG. 14(*a*), 14(*b*) and 14(*c*), Asuka C test is executed with the instrument regulated by the regulations shown in Table A.

However, for the test, the instrument is applied to the object until the object is in contact with the pressure surface, and the indicator is read.

Since the pressure needle of the instrument is protruded 2.54 mm from the pressure surface, if the object has an elasticity not less than the maximum elasticity of the test, the needle is pushed into the instrument completely by the object so that the indicator indicates 100°.

Otherwise, the indicator displays the hardness of the object according to the elasticity of the object with a number between 0° and 100°.

TABLE A

Figure 10:
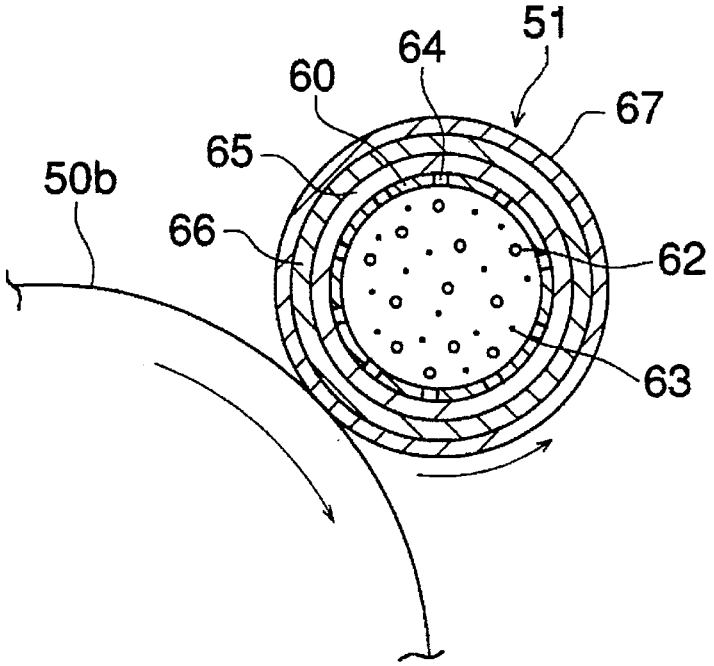
FIG. 10 is a cross sectional view of a coating roller.

| | Needle size | | Spring load | |
|---|---|---|---|---|
| Test | Maximum height | | Maximum height | Figure of needle |
| Asuka C | 2.54 mm | FIG. 10 | 55 g | 855 g |

Hardness of the upper roller: 91°
Roller outer diameter: ϕ30 mm
Outermost layer: Fluorine resin tube (50 μm)
Lower layer: Silicone rubber (0.5 mm) (JIS-A 40°)

TABLE 7

| Hardness of Lower roller (°) | Difference between the hardness of the upper roller and the lower roller | Nip pressure (N/cm) | Wrinkles on an envelope |
|---|---|---|---|
| 91 | 0 | 2.3 | Good |
| | | 5.5 | Good |
| | | 7.2 | Good |
| | | 9.8 | Good |
| 86 | 5 | 2.3 | Good |
| | | 5.5 | Good |
| | | 7.3 | Good |
| | | 9.2 | Good |
| 82 | 9 | 2.3 | Good |
| | | 3.9 | Good |
| | | 4.5 | Poor |
| | | 5.5 | Poor |
| 80 | 11 | 2.6 | Good |
| | | 3.0 | Poor |
| | | 5.5 | Poor |

Figure 11:
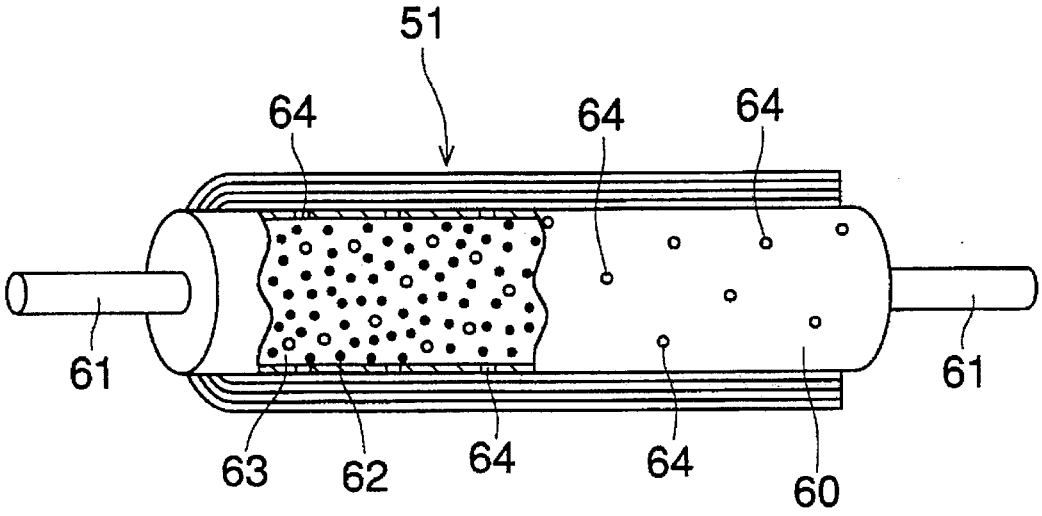
FIG. 11 is a perspective view of the coating roller.

As is apparent from Table 7, when the difference of the hardness of the upper roller and the lower roller is within 5°, wrinkling occurs rarely on the envelopes. Next, a structure of the coating roller will be explained. FIG. 10 shows a cross-sectional view of the coating roller, and FIG. 11 is a perspective view of the coating roller. Coating roller 51 has hollow pipe 6C, which is made of aluminum. At both ends of hollow pipe 60, shaft portion 61 is provided. By means of this shaft portion 61, the coating roller is brought into contact with upper roller 50*b* so that the coating roller can be rotated. In hollow pipe 60, inorganic or organic fine particle powder 62 wherein oil 63 is coated is filled. For the inorganic or organic fine particles, those having heat resistance temperatures of 1100° C. or more, are used so that a fluctuation of oil coating with heat can be reduced.

As the powder of the heat-resistant fine particles, "Silica Balloon", produced by Kushiro Sekitan Kanryu Co., Ltd., whose fused temperature is 1200° C. is heated until it bubbles. The above-mentioned product has the effect of enhancing the apparent viscosity due to mixing with a low-viscosity oil. Therefore, it is effective for retaining the oil in hollow pipe 60.

On hollow pipe 60, plural oil emitting holes 64 are drilled so that oil 63 can be emitted from oil emitting hole 64 to the exterior. On the outer surface of hollow pipe 60, layers of oil diffusion paper are rolled so that diffusion layer 65 is provided. In addition, on the outer turn of diffusion layer 65, an oil control paper is rolled so that control layer 66 is provided. On the outer turn of control layer 66, a layer of No-mex felt is rolled. In addition, on the outer turn of the No-mex felt, fine fiber non-woven fabric is rolled so that surface layer 67 is provided. As oil 63, a silicone oil, composed of a perfluoro group, whose surface tension is 20 dyne/cm or less and a viscosity is 500 cs less is used.

In hollow pipe 60 in coating roller 51, powder 62 wherein oil 63 is coated is filled forcing oil 63 through oil emitting holes 64 on hollow pipe 60. By impregnating oil 63 in powder 62, oil 63 is adsorbed by powder 62. Accordingly, oil 63, with low viscosity, which easily oozes out can be maintained, uniform coating can be conducted, the oil volume is small, rolling of a fully black image can be prevented and reliability can be increased noticeably.

As described above, control means 72 controls the coating amount of oil onto coating roller 51 based on image information 73 which forms a toner image on recording material P.

Namely, a fluoro-containing silicone oil is used for the oil. Coating roller driving means 71 is regulated to allow the rotation speed of coating roller to be variable. The coating amount is controlled to $1.4\times10^{-6}$ g/cm$^2$ or less so that only the oil amount as necessary is coated.

In cases when the copying apparatus is a multi-color machine, it is usually equipped with a mono-color mode and a multi-color mode. The oil coating amount is different for the mono-color mode and the multi-color mode. The oil coating amount in the mono-color mode is ¾ or less compared to the multi-color mode. The oil amount suitable for the mono-color mode and the multi-color mode is thus respectively coated onto the roller.

In addition, copying apparatus 1 is equipped with an OHP mode which records an image on OHP sheets and a normal mode which records an image on plain paper. In the case of the OHP mode, the line speed of the fixing roller is set to ½ or less of the normal mode, and the oil amount suitable for the OHP mode and the normal mode is thus coated respectively.

In the case of the OHP mode, the amount of toner stuck set during developing is reduced compared to the normal mode so that the transmission rate of the OHP mode is improved. In addition, in the case of the OHP mode, a transparent resin having a visco-elasticity close to the toner is coated on the uppermost layer of the OHP sheet so that the transmission rate of the OHP sheet is further improved.

Figure 12:
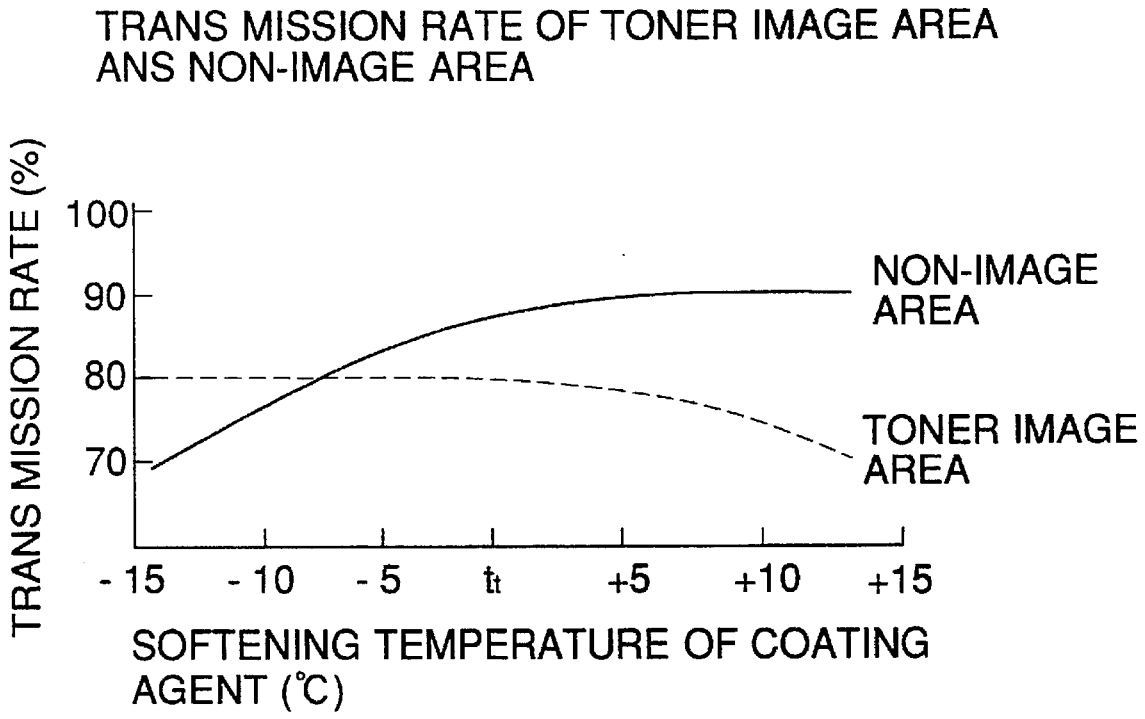
FIG. 12 is a drawing showing transmission rate of toner image portions and non-image portions of an OHP sheet.

The softening temperature tc of the transparent resin in the surface layer which is the outermost layer of the OHP sheet, compared to the softening point temperature $t_r$ of the toner, is shown as $(t_r-5C)<tc<(t_r+5°\ C.)$ In view of the above, the transmission rate of the toner image portion and the non-image portion of the OHP sheet is shown in FIG. 12.

In cases where $tc>(t_r+5°\ C.)$, the transmission rate of the toner image portion is low. In addition, solubility between the toner and the coating agent is so insufficient that the surface does not flatten.

In cases where $tc<(t_r-5° C.)$, the transmission rate of the non-image portion is too low. In addition, the coating agent becomes too softened so that unevenness due to adhesion with the fixing roller occurs. Accordingly, the surface also does not flatten.

Next, an example wherein the surface tension of the oil is 20 dyne/cm or less and a viscosity of 500 cs or less, will be explained. This example has the following effects.

First of all, the rolling property of the transfer paper onto the surface of the fixing roller and the oil property will be explained.

Oil 1: KF 96 produced by Shin-etsu Chemical Co., Ltd. (a conventional oil )

Surface tension: 21.1 dyne/cm

Viscosity (at 25° C.): 300 cs

TABLE 8

| | | | | |
|---|---|---|---|---|
| Amount of oil coating (mg/copy) | 1.1 | 1.3 | 1.9 | 2.1 |
| Rolling property of a transcribed paper | Poor | Poor | Good | Good |

Oil 2: Specific gravity of 1.52

Surface tension: 17.6 dyne/cm

Viscosity (at 25° C.): 300 cs

TABLE 9

| | | | | |
|---|---|---|---|---|
| Amount of oil coating (mg/copy) | 0.9 | 1.1 | 1.3 | 1.8 |
| Rolling property of a transcribed paper | Poor | Good | Good | Good |

In Table 9, 1.0 [mg/copy]

$=1.0/1.52$ [$g\times10^{-3}$/copy]

$=1.0\times1.52\times$(1/A4 size area)

$=1.09\times10^{-6}$ g/cm$^2$

Accordingly, by coating at least by $1.09\times10^{-6}$ [g/cm$^2$], rolling of the transfer paper can be prevented.

However, the value of $1.09\times10^{-6}$ [g/cm$^2$] is for when the toner which forms the image is maximum (an image superposed by a solid black image and 2 or more kinds of color toner), and the necessary coating quantity of the oil may be $1.09\times10^{-6}$ [g/cm$^2$] or less.

The coating amount of oil can be controlled by means of the number of rotations of the coating means. Since coating amount can be controlled in accordance with image signal informations and, unnecessary oil consumption can be prevented.

Oil 3:

Surface tension: 18 dyne/cm

Viscosity (at 25° C.): 10000 cs

In oil 3, extension of the oil onto the fixing roller is slower than oil 1. Therefore, rolling property of the transfer paper is poor.

Therefore, an oil having

Surface tension: 20 dyne/cm or less

Viscosity (at 25° C.): 500 cs or less can provide effective rolling property of the transfer paper in a reduced amount compared to conventional KF 96 produced by Shin-etsu Chemical Co., Ltd.

Next, the line speed of the fixing roller and the OHP transmission rate will be explained.

In the OHP mode, the line speed of the fixing roller is set to ½ or less compared to the normal mode. Ordinarily, in order to fix the toner onto the transfer paper sufficiently, heat is not necessary compared to a case of an OHP sheet transmitted image. The toner after being fixed is only enough in a status wherein graininess is more or less kept. On the contrary, in order to obtain a transmitting image of the OHP sheet, sufficient pressure and heat are necessary.

Figure 13:
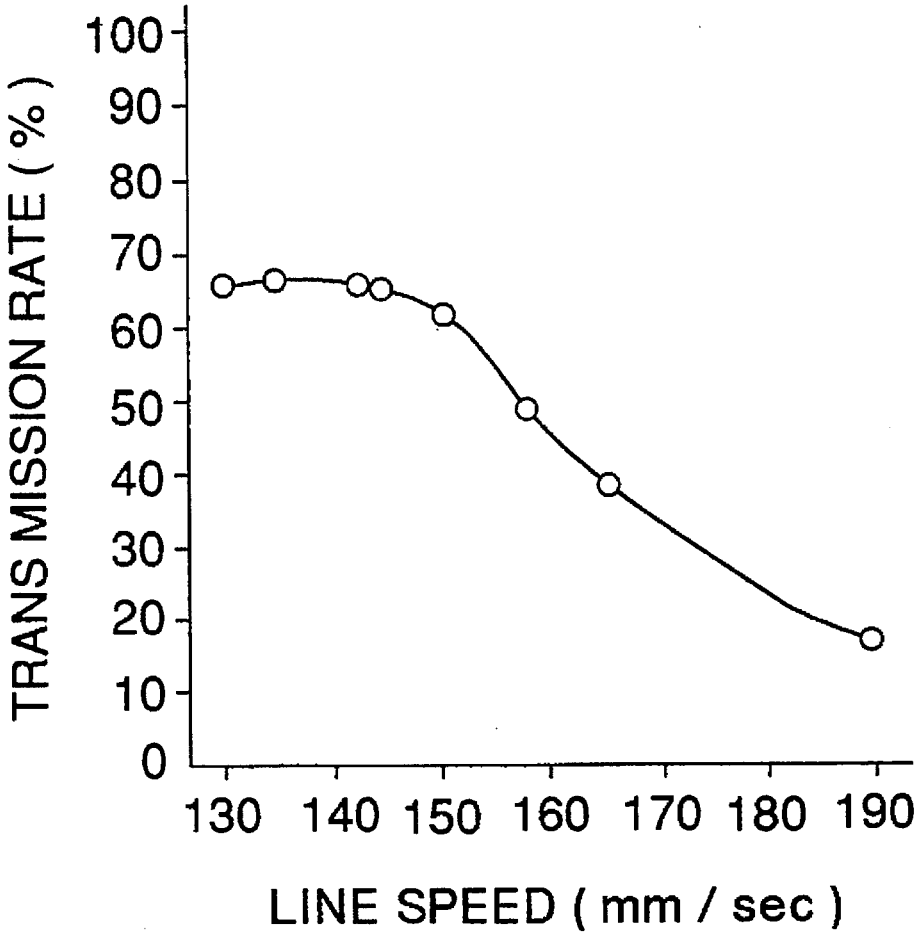
FIG. 13 is a drawing showing the line speed and the transmission rate of the fixing roller.

The graph in FIG. 13 shows the relationship between the line speed and the transmission rate of the fixing roller at 190° C. Though the fixing property to the transferred paper is enough at 80 mm/sec. in terms of line speed, transmission rate of an outputted image onto the OHP sheet is only 20% or less. Therefore, a projected image is completely dark. In order for the projected image to show color, the transmission rate of at least 50% or less is necessary. In addition, the line speed is preferable to be half or more of the normal mode.

As described above, according to the present invention, the upper roller of the fixing roller is composed of a base tube on which a silicone rubber layer and a resin layer are coated in that order or on which a resin layer is coated, the heat resistance of the above-mentioned upper roller is in a range of 2.5 through 7.9 cm·s·deg/cal, on the other hand, the lower roller is composed of a base tube on which a silicone rubber layer is provided and the roller hardness of the lower roller is within ±5° compared to the upper roller hardness. Accordingly, according to the present invention, as recording medium, not only a plain paper but also a thicker recording medium such as an envelope can be conveyed without wrinkling so that fixing processing can be conducted on any medium.

What is claimed is:

1. A toner image forming method, comprising steps of:

(1) forming a latent image on an image carrying member, (2) developing said latent image with toner particles including a resin and a colorant so as to form a toner image, said toner particles having a volume average particle size of 5 to 10 μm, and containing toner particles having particle sizes of not more than 5.04 μm in 5 number·% to 60 number·%, (3) transferring said toner image onto an image receiving material, and (4) fixing said transferred toner image on said image receiving material, said fixing steps comprising (a) passing said image receiving material between a movable fixing member and a rotatable pressure applying member each having a surface facing each other, (b) heating said toner image by a heater incorporated in said fixing member, and (c) coating the surface of said fixing member facing said pressure applying member with a fluorine-containing silicone oil by a coating roller, said fluorine-containing silicone oil having a structure unit represented by Formula I: Formula I

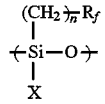

wherein X represents an alkyl group having 1 to 4 carbon atoms or an aryl group, Rf represents a fluoroalkyl group having 2 to 10 carbon atoms and n represents an integer of 1 to 4.

2. The method of claim 1, wherein said fixing member is a fixing roller, and a layer containing said fluorine-containing silicone resin oil is coated on a surface of said fixing roller.

3. The method of claim 1, wherein said fixing member is a band-shaped film type member, and a layer containing said fluorine-containing silicone oil is coated on a surface of said band-shaped film type member.

4. The method of claim 1, wherein Rf of said fluorine-containing silicone oil represents a $Z\text{-}(CF_2)_m\text{-}$ group, wherein Z represents a hydrogen atom or a fluorine atom, m represents an integer of 2 to 10.

5. The method of claim 1, wherein said fluorine-containing silicone oil has a viscosity of 20 to 1,000 centi-poise (CS) at 25° C.

6. The method of claim 2, wherein said fixing roller comprises a base tube having thereon a silicone rubber layer, and a resin layer in this order, said pressure applying roller comprises a base tube having thereon a silicon rubber layer, wherein said fixing roller has a heat resistance of 2.5 to 7.9 cm·sec·deg/cal, and the difference of said pressure applying roller hardness to said fixing roller hardness is −5° to +5°.

7. The method of claim 6, wherein said fixing roller has a silicone rubber layer thickness of 0.2 to 1 mm, and said pressure applying roller has a silicone rubber layer thickness of 0.5 to 2 mm.

8. The method of claim 2, wherein said coating roller has a hollow pipe containing seal inorganic fine particles or organic fine particles so as to maintain said fluoro-containing silicone oil, and said inorganic fine particles and organic fine particles have a heat-durability temperature of not less than 1100° C.

9. The method of claim 1, wherein said fluoro-containing silicone oil has a viscosity of not more than 500 centi-poise, and said fluoro-containing silicone oil is coated in an amount of $1.09\times10^{-6}$ to $1.4\times10^{-6}$ g/cm$^2$.

* * * * *